US010122117B2

(12) United States Patent
Miller et al.

(10) Patent No.: US 10,122,117 B2
(45) Date of Patent: Nov. 6, 2018

(54) QUICK CONNECT POWER CONNECTOR SYSTEM

(71) Applicant: TYCO ELECTRONICS CORPORATION, Berwyn, PA (US)

(72) Inventors: Keith Edwin Miller, Manheim, PA (US); John Anthony Fulponi, Harrisburg, PA (US); Lawrence Se-Jun Oh, Hummelstown, PA (US); John Louis McKibben, Dallastown, PA (US); Dustin Carson Belack, Hummelstown, PA (US); Lynn Robert Sipe, Mifflintown, PA (US); Robert Mulfinger, York Haven, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 176 days.

(21) Appl. No.: 15/095,323

(22) Filed: Apr. 11, 2016

(65) Prior Publication Data

US 2016/0308304 A1 Oct. 20, 2016

Related U.S. Application Data

(60) Provisional application No. 62/147,380, filed on Apr. 14, 2015.

(51) Int. Cl.
*H01R 13/639* (2006.01)
*H01R 13/627* (2006.01)
(Continued)

(52) U.S. Cl.
CPC ..... *H01R 13/6271* (2013.01); *H01R 11/282* (2013.01); *H01R 13/20* (2013.01);
(Continued)

(58) Field of Classification Search
CPC ..... H01R 13/6277; H01R 13/62927; H01R 13/62955; H01R 13/635; H01R 13/641; H01R 13/639; H01R 11/282
See application file for complete search history.

(56) References Cited

U.S. PATENT DOCUMENTS 2,487,917 A 11/1949 Adams
5,672,442 A * 9/1997 Burnett ..... H01M 2/305 429/121

(Continued)

FOREIGN PATENT DOCUMENTS

EP 1369957 A1 12/2003
EP 1737082 A2 12/2006
GB 693952 A 7/1953

OTHER PUBLICATIONS

Annex to International Search Report, Application No. PCT/US2016/027404, International Filing Date, Apr. 14, 2016.

*Primary Examiner* — Felix O Figueroa

(57) ABSTRACT

An electrical connector and system for connecting to a terminal post. The electrical connector includes a housing body, a contact and a locking release member. The housing body includes a post receiving passage for receiving the terminal post therein. The contact is provided in the post receiving passage and is positioned about the circumference of the post receiving passage. The contact will make an electrical engagement with a terminal post inserted into the post receiving passage regardless of the orientation of the terminal post with respect to the contact. The electrical connector which prevents the improper mating of the connector to the post, prevents unwanted rotation of the connector, provides a visual indication that the proper connection is secured and provides a secondary lock to ensure that unwanted unmating of the connector does not occur.

19 Claims, 23 Drawing Sheets

(51) Int. Cl.

| | |
|---|---|
| ***H01R 13/20*** | (2006.01) |
| ***H01R 13/625*** | (2006.01) |
| ***H01R 13/641*** | (2006.01) |
| ***H01R 11/28*** | (2006.01) |
| *H01R 101/00* | (2006.01) |

(52) U.S. Cl.
CPC ..... *H01R 13/625* (2013.01); *H01R 13/6277* (2013.01); *H01R 13/639* (2013.01); *H01R 13/641* (2013.01); *H01R 2101/00* (2013.01)

(56) References Cited

U.S. PATENT DOCUMENTS

| | | | | |
|---|---|---|---|---|
| 6,030,722 | A * | 2/2000 | Kuboshima | H01M 2/206 429/178 |
| 6,776,669 | B2 * | 8/2004 | Krause | H01R 4/48 439/388 |
| 6,817,893 | B2 * | 11/2004 | Schmid | H01R 11/282 439/522 |
| 6,846,195 | B2 * | 1/2005 | Annequin | H01R 13/639 439/352 |
| 7,040,912 | B2 * | 5/2006 | Mimoto | H01R 13/6277 439/352 |
| 8,038,484 | B2 * | 10/2011 | Selvitelli | A61B 5/0416 439/729 |
| 8,608,506 | B2 * | 12/2013 | Zhao | H01R 13/6277 439/522 |
| 2013/0090000 | A1 | 4/2013 | Zhao | |
| 2015/0372400 | A1 * | 12/2015 | Mills | H01R 13/42 439/660 |
| 2017/0271815 | A1 * | 9/2017 | Lane | H01R 13/6272 |

* cited by examiner

QUICK CONNECT POWER CONNECTOR SYSTEM

FIELD OF THE INVENTION

The present invention is directed to an electrical connector system having an electrical connector which provides a quick, simple and reliable connection to mating post. In particular, the invention is directed to an electrical connector which prevents the improper mating of the connector to the post, prevents unwanted rotation of the connector, provides a visual indication that the proper connection is secured and provides a secondary lock to ensure that unwanted unmating of the connector does not occur.

BACKGROUND OF THE INVENTION

Electrical connectors for military, aviation, vehicular and other applications which required power must be able to withstand the environmental conditions, such as high vibrations, to which such connectors are subjected. The connectors also must provide high quality electrical connection through very broad ranges of temperature variations. Additionally, electrical connectors that are disposed in engine compartments and the like must protect against the inadvertent but inevitable manual contact that occurs as a mechanic tries to access a nearby component disposed in the crowded compartment. In many instances, these electrical connectors must also accommodate extremely high amperage.

Such electrical connectors which are found in the prior art typically include a threaded stud terminal to which a threaded nut may be selectively connected. A typical prior art terminal for connection to such threaded stud terminal includes a mating end effectively defining a generally planar eyelet that is dimensioned to be slidably passed over the threaded stud terminal. The opposed end of such a terminal typically will be crimped and/or soldered to a conductor of the wire. The eyelet is maintained in a mated condition on the threaded stud terminal by the nut which is threaded tightly against the planar portion of the eyelet for securely retaining the terminal on the threaded stud terminal and for providing the high contact forces that are desired.

Such typical prior art electrical connectors perform well under routine environmental conditions. However, the threaded components of these prior art connectors are fairly expensive to manufacture. Furthermore, the threaded interconnection adds significantly to assembly time and costs and can make disassembly for periodic repair and maintenance difficult, particularly as torque wrenches are required to properly seat the hardware. A number of parts are required to perfect the electrical connection, thereby also adding to the cost of the connection and creating the possibility of foreign object debris (FOD) which could damage engines and the like. Also, as the connectors are exposed to vibration and the like, the nuts may rotate off of the threaded component, which can lead to a failed, open electrical connection. In addition, any attempt to provide environmental sealing for such an electrical connection will generally require an entirely separate protection means that is functionally and structurally unrelated to the threaded interconnection to the alternator.

Many prior art electrical connectors rely upon resiliency of the metal to achieve electrical connection. However, it is extremely difficult to achieve the high contact forces with an electrical connector that must also ensure a large surface contact area and a large cross sectional area of metal to effect a reliable electrical connection. Other prior art electrical connectors have included spring means which are intended to achieve secure electrical connection without resorting to combinations of threads and nuts. Still other connectors have included a stamped member having a pair of deflectable arms with apertures extending therethrough. The arms can be biased such that the apertures align with one another to permit insertion of a pin through the aligned apertures. However, when the biasing force on the arms is released, the arms resiliently return to a condition where they bind against the pin inserted through the apertures. The prior art further includes the use of clips which perform no direct electrical connection function but which securely retain the housings of two electrical connectors together.

In applications which do not use threaded components or the like, simple insertion of the connector onto terminal posts does not assure that the connectors are properly positioned and locked in place. In order to be sure that the components are properly connected and electrically engaged, a latch assembly/position assurance member is provided. Often, an audible click is typically used to detect if the connector is fully mated; however, background noise can make this ineffective.

However, even with these position assurance members, a number of connectors and terminals are not fully mated, causing system failures. This is due to the fact that some connectors and terminals are mated far enough to make initial, electrical contact but the latches of the position assurance members are not fully engaged, causing the connector to not be locked or secured on the terminal. These connectors later come apart in the field, e.g. as a vehicle is driven on bumpy roads etc., causing loss of system function. Therefore, incorporating position assurance members into the connectors does not guarantee that the connectors will be properly mated and secured, as in many instances the operator does not properly activate the position assurance member.

It would be beneficial to have connectors which overcome the problems identified above. It would also be beneficial to allow for quick connection without the use of tools, prevent the rotation of the connector after mating to a post and provide for a visual means to assure that the connectors are properly mated.

SUMMARY OF THE INVENTION

In view of the above, it is an object to provide a connector which provides a quick, simple and reliable connection to mating connectors or posts and to the power bus to which the posts are connected.

It is another object to provide a high amperage electrical connector that enables quick connection and disconnection.

It is another object to provide a connector with a locking member to maintain the connector in position on the post or mating contact.

It is another object to provide a connector with a visual indication which provides a quick and cost effective means to confirm that the connection is secured.

It is another object to provide a one piece connector, thereby eliminating loose components which can fall during installation or which can come loose during operation.

It is another object to provide a connector which requires no tooling to install.

It is another object to provide a connector which can be inserted onto a post from any direction, thereby allowing the connector be terminated to the post regardless of orientation.

It is another object to provide a connector in which the electrical connection to the post will remain secure regardless of vibration or other environmental conditions.

It is another object to provide a secondary lock which maintains the connector in place relative to the post and eliminates the unwanted disengagement thereof.

It is another object to provide an anti-rotation option in applications in which it is desirable to have a fixed orientation of the connector relative to the post.

It is another object to provide an in-line connector with many of the features recited above.

It is another object to provide a rotational bayonet latching connector.

An embodiment is directed to an electrical connector system for connecting an electrical connector to a terminal post. The electrical connector system includes an electrical connector which has a housing body with a post receiving passage for receiving the terminal post therein. A contact is provided in the post receiving passage. The contact is positioned about the circumference of the post receiving passage wherein the contact will make an electrical engagement with a terminal post inserted into the post receiving passage regardless of the orientation of the terminal post with respect to the contact. A locking release member is moveably mounted to the housing body. The locking release member is moveable between a first position and a second position. The locking release member cooperates with a locking spring member which has a locking section which cooperates with a recess of the terminal post when the locking release member is in the first position.

A secondary lock member may be provided to prevent the unwanted disengagement of the connector from the terminal post. The secondary lock member is moveable between a first position and a second position.

An anti-rotation device may be provided to minimize or eliminate the effects of movement of the connector relative to the terminal post.

A mating projection may extend from a top surface of the terminal post, a mating indicator is positioned on the mating projection, wherein when the terminal post is fully inserted into the housing body, a top portion of the mating indicator is positioned in an opening of a top end of the housing body to provide a visual indication that the connector is fully mated to the terminal post.

An embodiment is directed to an in-line electrical connector for connecting to a terminal post. The in-line electrical connector includes a housing body which has a post receiving passage for receiving the terminal post therein. A contact is provided in the post receiving passage. The contact is positioned about the circumference of the post receiving passage wherein the contact will make an electrical engagement with terminal posts inserted into the post. A locking release member is moveably mounted to the housing body. The locking release member is moveable between a first position and a second position. The locking release member cooperates with a locking spring member which has a locking section which cooperates with a recess of the terminal post when the locking release member is in the first position.

An embodiment is directed to a rotational bayonet electrical connector for connecting to a terminal post. The electrical connector includes a housing body which has a post receiving passage for receiving the terminal post therein. A contact is provided in the post receiving passage. The contact is positioned about the circumference of the post receiving passage wherein the contact will make an electrical engagement with terminal posts inserted into the post. Locking projections extend from a second end of the housing body and are configured to cooperate with locking projection receiving recesses and a locking recess which extends about a portion of the perimeter of a connector receiving recess portioned proximate the terminal post.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
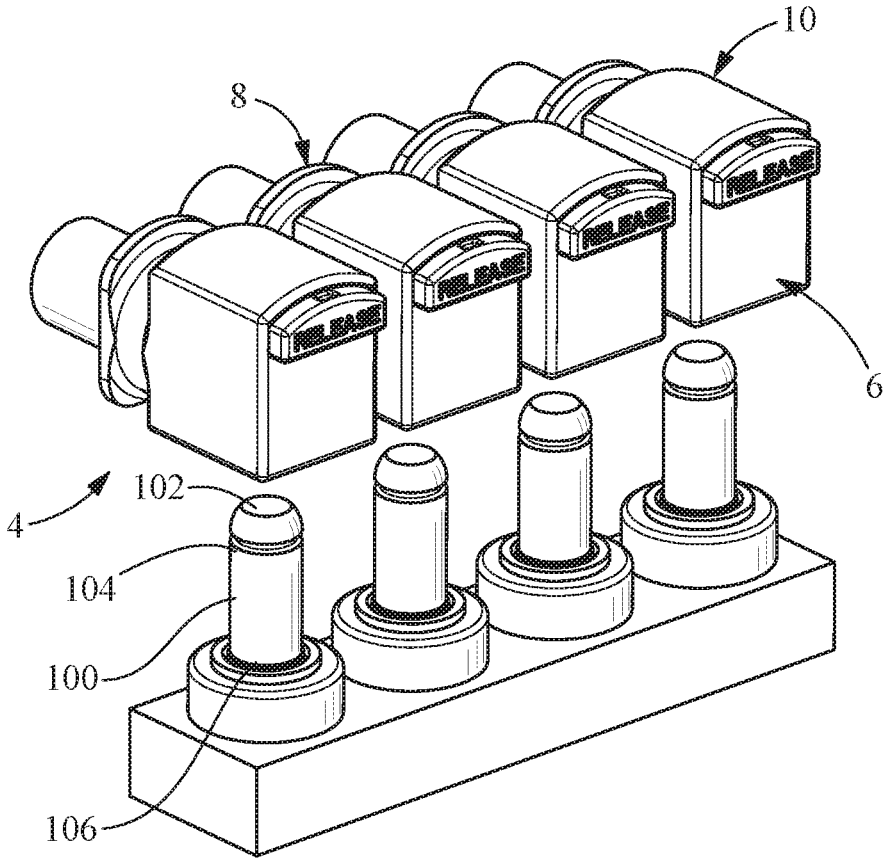
FIG. 1 is a perspective view of an illustrative embodiment of four quick connect power connectors according to the present invention shown prior to mounting to mating connectors or posts, the mating posts having keying members positioned thereon.
Figure 2:
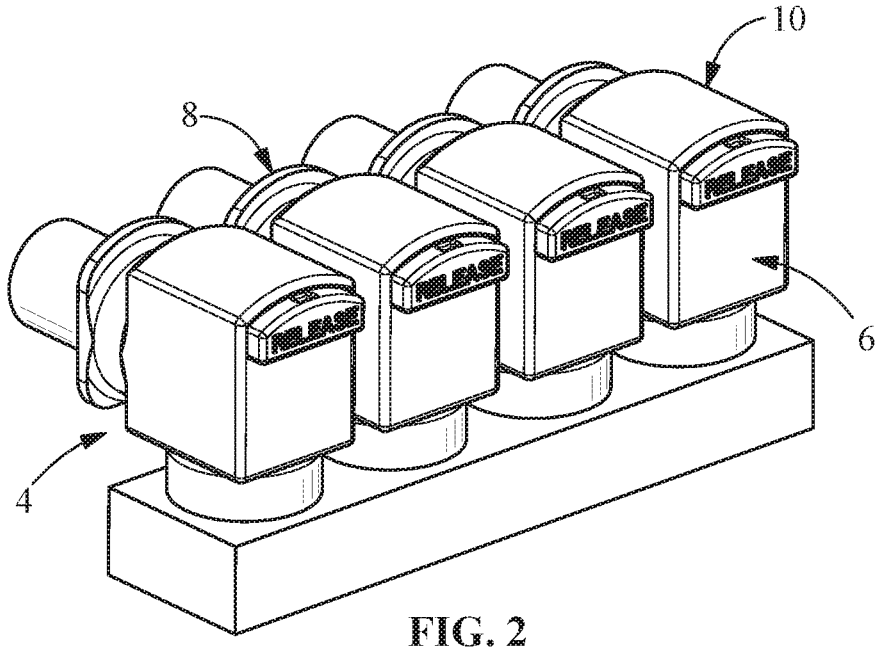
FIG. 2 is a perspective view of the four quick connect power connectors of FIG. 1 fully mated to the mating posts.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

Figure 15:
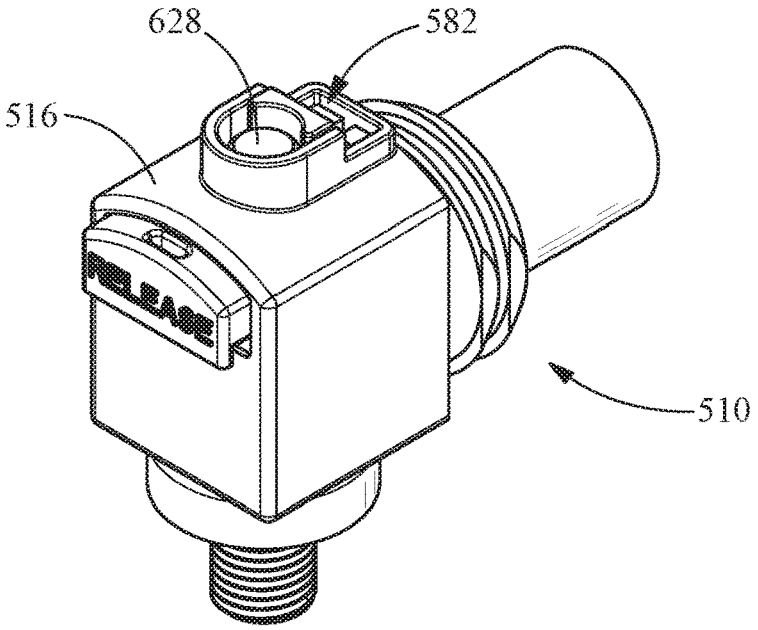
FIG. 15 is a perspective view of the alternate illustrative embodiment of the quick connect power connector of FIG. 14 in the latched or locked position.
Figure 16:
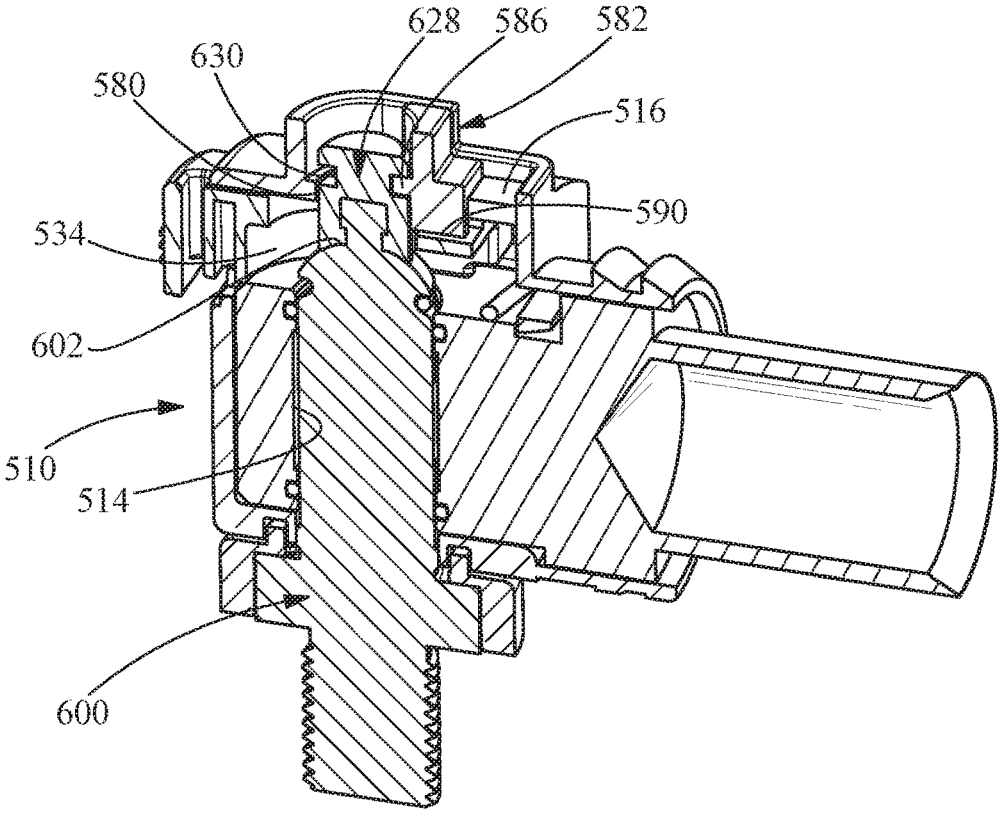
FIG. 16 is a cross-sectional view of the quick connect power connector of FIG. 15.
Figure 17:
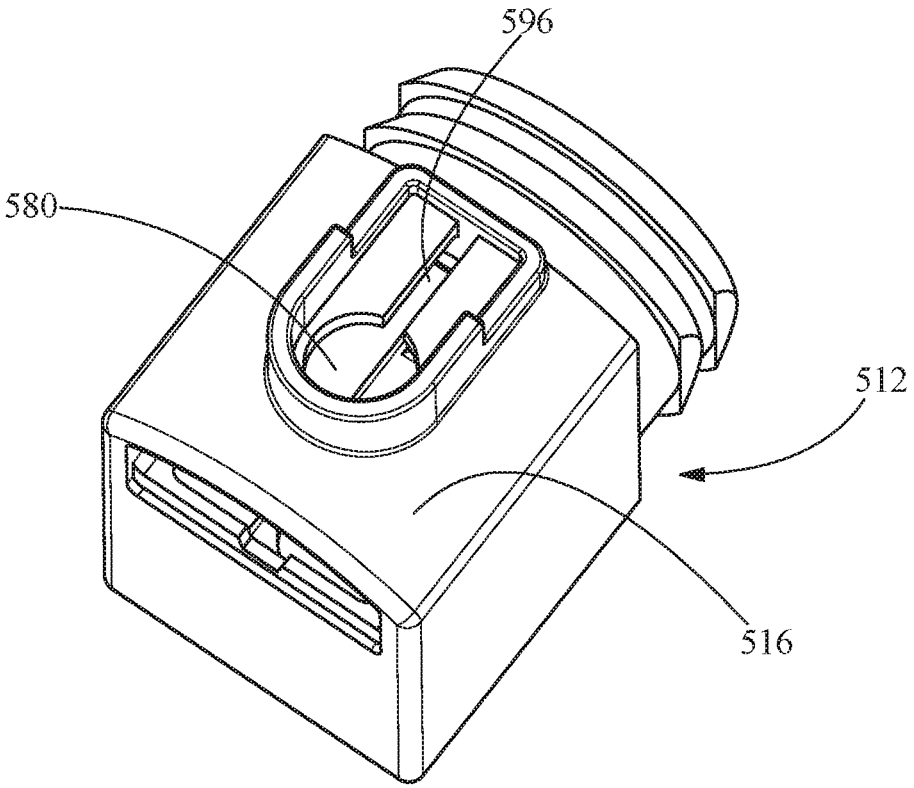
FIG. 17 is a perspective view of the housing of the quick connect power connector of FIG. 15.
Figure 18:
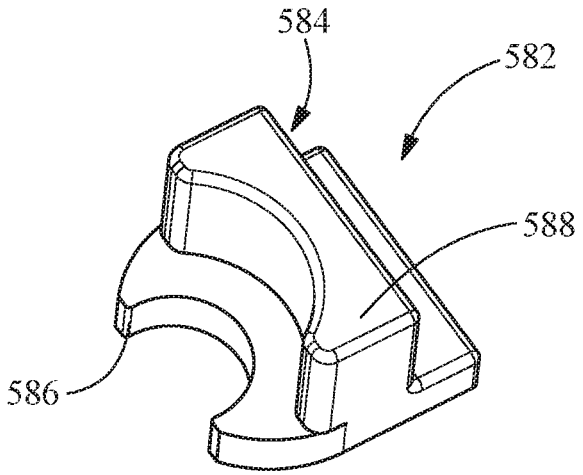
FIG. 18 is a top perspective view of the secondary lock shown in FIG. 15.
Figure 19:
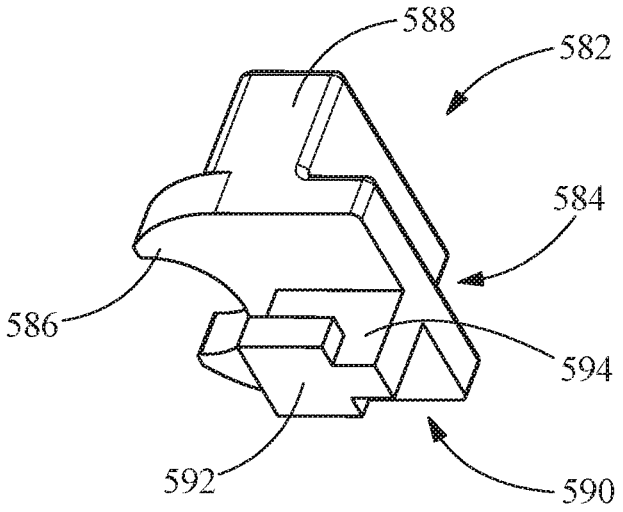
FIG. 19 is a bottom perspective view of the secondary lock of FIG. 18.

FIG. 1 shows a perspective view of four electrical connectors or plugs 4, 6, 8, 10 prior to insertion on male posts or mating pins 100, 101, 103, 105. FIG. 15 illustrates the connectors 4, 6, 8, 10 fully mated to the posts 100, 101, 103, 105. The electrical connectors 4, 6, 8, 10 and posts 100 are shown as illustrative representations. The particular configuration of the connectors 4, 6, 8, 10 and posts 100, 101, 103, 105 may vary without departing from the scope of the invention. While four connectors 4, 6, 8, 10 are shown, any number of connectors can be used without departing from the scope of the invention. As will be more fully described below, the connectors 4, 6, 8, 10 and the posts 100, 101, 103, 105 are configured and are rated to carry different electrical loads.

Figure 3:
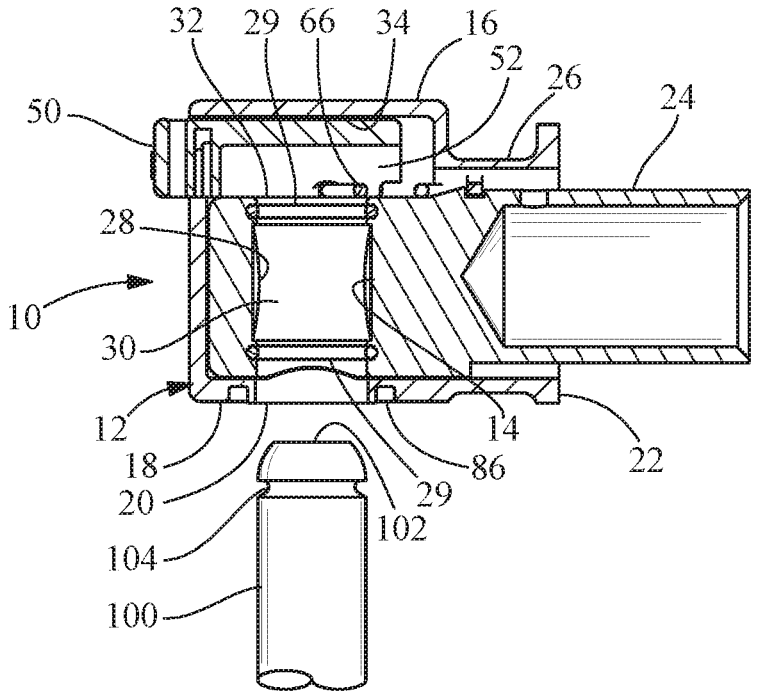
FIG. 3 is a cross-sectional view of one quick connect power connector of FIG. 1 in alignment with a mating post, illustrating the quick connect power connector prior to the mating post engaging a locking member.
Figure 4:
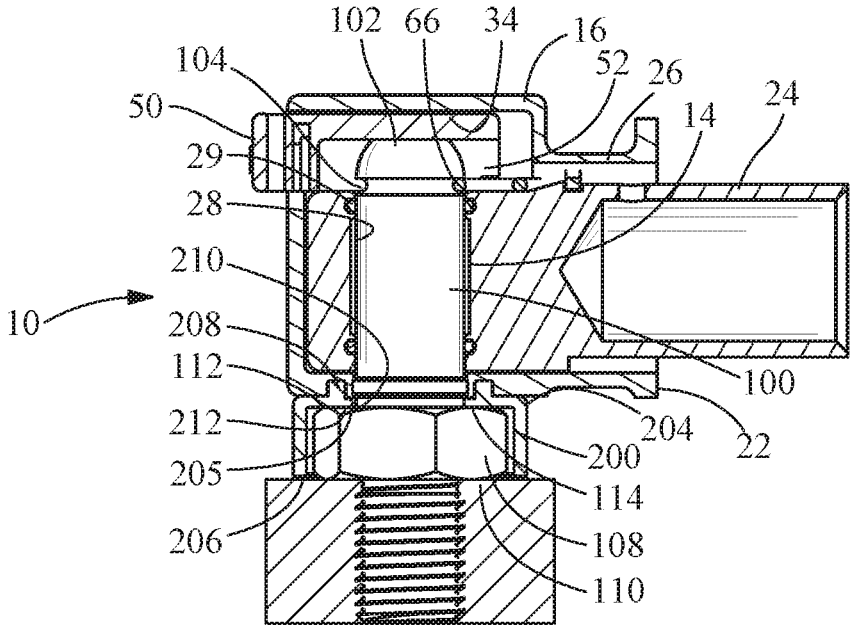
FIG. 4 is a cross-sectional view of the quick connect power connector of FIG. 3, illustrating the quick connect power connector in the latched or locked position.

As connectors 4, 6, 8, 10 have many similar components, for ease of description and understanding, only one connector 10 will be described in detail. However, connectors 4, 6, 8 have similar components to those described herein. Referring to FIGS. 3 through 7, each electrical connector 10 has a housing body 12 with a post receiving passage 14 for receiving a respective post 100 therein. As best shown in FIGS. 3 and 4, each electrical connector 10 has a first or top end 16 and an oppositely facing second or bottom end 18 which has an opening 20 to receive the post 100 therethrough. The opening 20 extends to the post receiving passage 14. A conductor or wire receiving sidewall 22 extends between the first end 16 and the post receiving end 18. A conductor or wire (not shown) is inserted into a conductive wire receiving member 24 which extends from the sidewall 22 and is terminated thereto by crimping or other known termination methods. An insulation receiving recess 26 extends circumferentially around the conductive wire receiving member 24. The insulation receiving recess 26 allows an insulator, such as, but not limited to, a boot, to be installed over the conductive wire receiving member 24, thereby insulating the conductive wire receiving member 24 from other components and the operator. In the embodiment shown, the conductive wire receiving member 24 is a separate member made from conductive material.

A contact 28 (FIGS. 3 and 4) is positioned in the post receiving passage 14. In the embodiment shown, the contact 28 is a band which extends around the circumference of the passage 14. The band has resilient contact arms which extend into the passage 14 (as best shown in FIG. 3). As the post 100 is inserted into the passage 14, the contact arms 30 are resiliently deformed and are placed in electrical contact with the post 100. The contact 28 is positioned in the passage 14 such that the contact 28 will be placed in electrical engagement/contact with the post 100 regardless of the orientation of the contact 28 with respect to the post 100. This allows the wire receiving member 24 to be oriented at any position about the circumference of the post 100. The conductor and wire provided in the wire receiving passage 26 are electrically connected to the contact 28 using known methods of termination. While the contact 28 is shown in the form of a band, other types of contacts can be used without departing from the scope of the invention, such as, but not limited to, the contact element described in co-pending U.S. patent application Ser. No. 14/336,356, filed contemporaneously herewith, which is hereby incorporated by reference in its entirety. Sealing members 29 are provided above and below (as viewed in FIGS. 3 and 4) contact 28. The sealing members 29 prevent moisture or other types of contaminants from affecting the electrical connection between the contact 28 and the post 100 when the connector 10 is inserted on the post 100. In the embodiment shown, the sealing members 29 are O-rings made of rubber. However, other types of sealing member and other materials may be used without departing from the scope of the invention.

A terminal post receiving opening 32 extends through or is provided proximate to the first or top end 16 of the body 12 of the connector 10. The opening 32 is positioned in alignment with post receiving passage 14. The opening 32 is dimensioned to receive a free or top end 102 of the post 100 therein.

A locking release cavity 34 (as best shown in FIGS. 3, 4, 6, 7) is provided proximate end 16. The locking release cavity 34 extends across opening 32 and, in the embodiment shown, extends essentially the entire width of the connector 10.

A locking release member 50 is positioned in the cavity 34. The locking release member 50 is slidably mounted in the cavity 34 of connector body 12. The locking release member 50 has a recess or cavity 52 which receives the top end 102 of the post 100 therein. The recess 52 is dimensioned to be larger than the top end 102 of the post 100 to allow the locking release member 50 to move relative to the top end 102 of the post 100, as will be more fully described.

Figure 5:
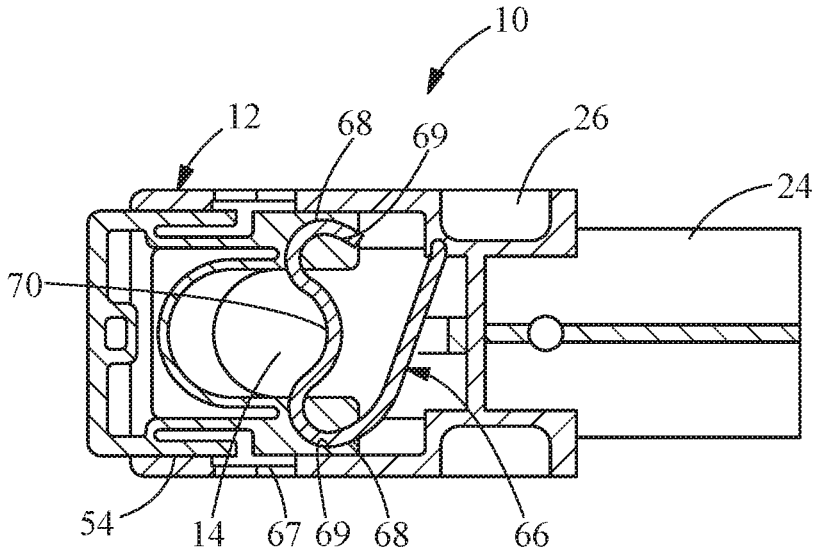
FIG. 5 is a cross-sectional view of one quick connect power connector of FIG. 1 taken along line 5-5, illustrating the locking member in a first position.
Figure 6:
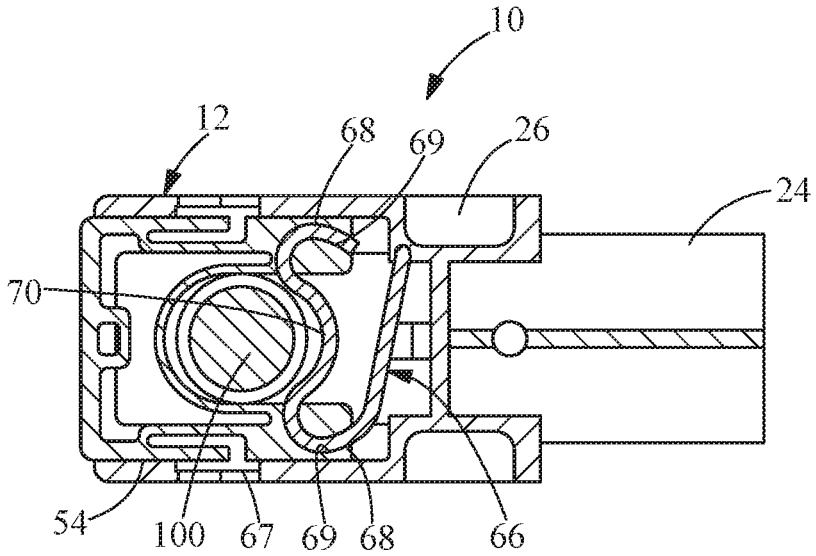
FIG. 6 is a cross-sectional view of a quick connect power similar to that of FIG. 5, illustrating the locking member in a second position.
Figure 7:
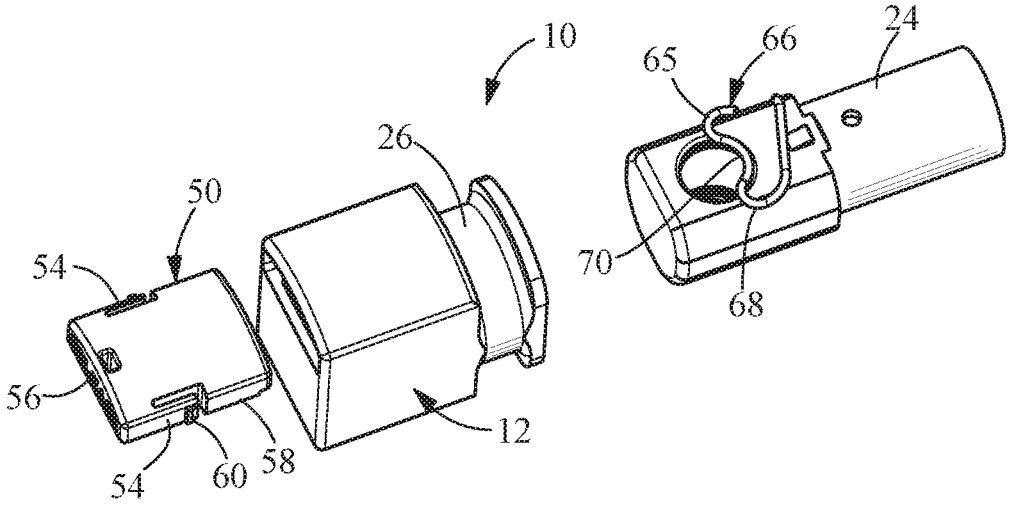
FIG. 7 is an exploded perspective view of one quick connect power connector of FIG. 1, illustrating the locking member in a first position.
Figure 8:
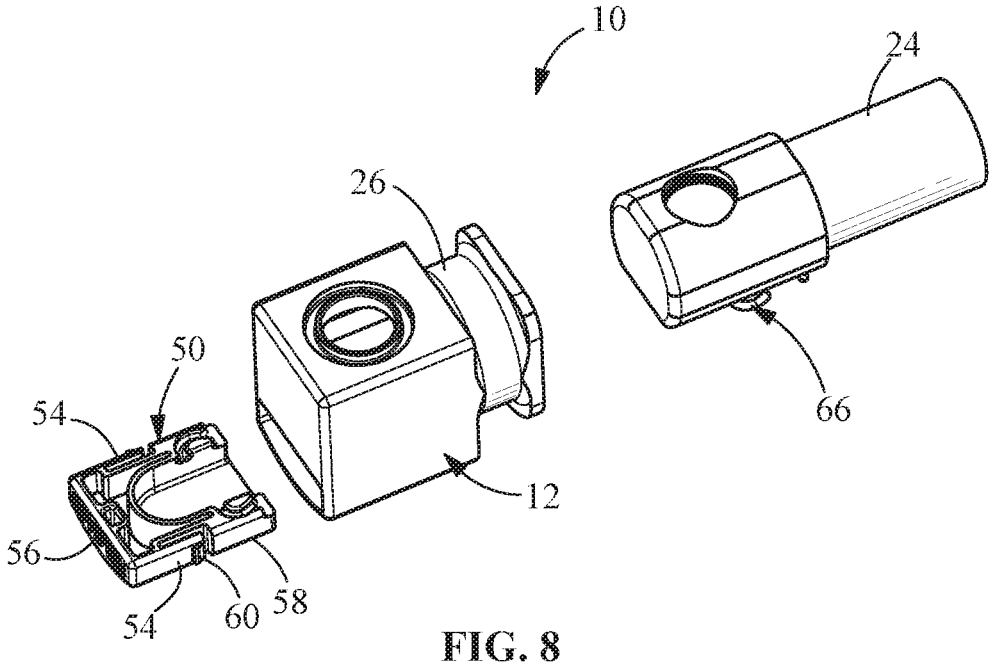
FIG. 8 is a bottom exploded perspective view of the quick connect power connector of FIG. 7.

Latching arms 54 (as best shown in FIGS. 7 and 8) extend from an engagement surface 56 of locking release member 50 proximate side surfaces 58. The latching arms 54 are provided on either side of locking release member 50. Each latching arm 54 has a projection 60 which is dimensioned to be received in an opening 61 of the body 12 of the connector 10, as best shown in FIGS. 5 and 6. The projections 60 are movable in the openings 61 between a first position and a second position, as will be more fully described.

A locking spring member 66 is housed in the cavity 34 and cooperates with the release member 50. The locking spring member 66 may be retained in the cavity 34 by known securing techniques, such as by placement of a mounting portion of the spring 66 in a mounting opening or cavity of the body 12 of the connector 10. The locking spring member 66 is also retained to the locking release member 50, whereby the locking spring member 66 moves together with the locking release member 50. As best shown in FIG. 6, the locking spring member 66 has a pair of mounting sections 68 which are positioned in recess 69 of the locking release member 50. Extending between the sections 68 is a locking section 70 which has a radiused locking surface which cooperates with the post 100, as will be more fully described.

When the electrical connector 10 is mated with the mating post 100, the post 100 is received within the post receiving passage 14 of the electrical connector 10, as best shown in FIG. 4.

FIG. 3 shows a cross-sectional view of the electrical connector 10 as the electrical connector 10 is being mated with the post 100. This view illustrates the post 100 positioned in the post receiving passage 14 prior to engaging the locking spring member 66. The locking spring member 66 and the locking release member 50 are shown in a first or pre-stressed position. In this position, the locking spring member 66 is in a first position. In this position, the spring 66 is partially or slightly deflected, causing the locking release member 50 to be biased toward the first position, as shown in FIG. 5. In this position, projections 60 engage walls of openings 61, thereby preventing the removal of the locking release member 50 from the cavity 34. This provides the operator with a visual indication that the locking release member 50 is in the first position. In this first position, the radiused locking section 70 extends into the space defined by the longitudinal extension of the side wall of the opening 14.

As insertion of the post 100 into the post receiving passage 14 continues, the top end 102 of post 100 moves through opening 32 and engages locking section 70, as best shown in FIG. 6, causing the locking spring member 66 to be resiliently deformed, allowing the top surface 102 of the post 100 to move beyond the locking section 70 of the spring 66. This movement is controlled and limited by the cooperation of the engagement of the projections 60 with the sidewalls of openings 61.

As the spring 66 is deformed, the locking release member 50 and the spring 66 are moved from the first position (FIG. 5) to the second or transition position (FIG. 6). With the pin 100 fully inserted, the spring 66 is returned toward the first position. However, if the connector 10 is not properly mated with the post 100, the locking release member 50 will not be allowed be returned to or toward the first position, as will be described.

As the locking release member 50 is moved from the first position of FIG. 5 to the transition position of FIG. 6, the locking section 70 is moved out of opening 14. As movement of the post 100 continues, the locking section 70 is aligned with a locking surface receiving recess 104 of post 100, allowing the spring 66 to resiliently return toward the first position, moving the locking section 70 in the recess 104 to secure the connector 10 to the post 100. In the embodiment shown, the recess 104 extends circumferentially about the surface of the post 100 proximate end 102. As the recess 104 extends about the entire circumference of the post 100, the locking section 70 can engage the recess 104 of the post 100 regardless of the orientation of the connector 10 with respect to the post 100. This allows the wire receiving member 24 to be oriented at any position about the circumference of the post 100. With the post 100 properly inserted into the connector 10, the locking surface 72 is moved into the recess 104 which allows the locking spring member 66 and the locking release member 50 to be moved to the fully locked position, as shown in FIG. 4. However, if the post 100 is not fully inserted, the locking surface 72 will not be aligned with the recess 104. Consequently, the locking spring member 66 and the locking release member 50 cannot be returned to or toward the first or locked position, thereby providing a visual indication that the connector 10 is not properly inserted onto the post 100.

The resiliency of spring 66 prevents the unwanted movement of the locking spring member 66 and the locking release member 50 back toward the transition or open position. Consequently, as the locking release member 50 and locking spring member 66 are retained in the closed or locked position, environmental conditions, such as, but not limited to, vibration, do not result in the inadvertent or unwanted electrical disengagement of the connector 10 from the post 100. This ensures that a positive electrical connection will be maintained.

If the connector 10 is to be disengaged from the post 100, the operator presses the locking release member 50 inward, causing the locking release member 50 to move the locking spring member 66 to the transition or open position. This moves the locking section 70 out of the recess 104, allowing the connector 10 to be removed from the post 100.

The connector system and method described herein provides a simple and reliable connector to mating posts and to the power bus to which the posts are connected. The connector is inserted onto the post making an electrical connection thereon. The use of the locking slide ensures that the connector is fully inserted onto the post, thereby ensuring that a positive electrical connection is provided and maintained. The visual indication provides a quick and cost effective means to confirm that the connection is secured.

The connector 10 and release member 50 are retained together and act as one piece. Consequently, there are no loose components which can fall during installation or which can come loose during operation. Therefore, potential damage to the equipment from foreign object debris is greatly reduced. In addition, as the connectors required no tooling to install, the installation of the connectors is greatly simplified.

The one piece connector according to the present invention performs all of the functions of the prior art multi component connectors. The one piece design results in a significant cost advantage over the prior art connectors.

The configuration of the connector 10, the contact 28 and the locking spring 66 allow for the connector to be inserted onto the post 100 from any direction. In many circumstances, it is difficult to manipulate and twist the wire connected to the contact 28 through the wire receiving member 24. Often because of lack of space or the inflexibility of the wire, it is important that the connector 10 be able to be terminated to the post regardless of the orientation of the wire relative to the post. As the contact 28 and locking spring 66 are operable no matter the orientation relative to the post, the present invention allows the termination of the wire to the post without damage to the wire or the post.

The use of the locking release member 50 and locking spring 66 allows the connector 10 to remain in electrical engagement with the post 100, regardless of the environmental conditions to which the connector and system are exposed. For example, vibration applied to either the post or the connector will not cause the failure of the electrical connection there between.

While the quick connect and disconnect connector can be used for many application, the configuration allows for use with high amperage electrical connections which require up to 1000 amps per contact.

The body 12 of the connector 10 and the locking release member 50 are made from plastic or other material having nonconductive properties. Consequently, the connector 10 and the release member 50 may be engaged by the operator/user.

The posts 100 and connectors 10 can be used for power or ground connections. In addition, the posts 100 and connectors 10 can be used to carry different amperage and/or different voltage. It is, therefore, essential that only connectors with similar electrical properties/characteristics be allowed to mate with respective posts. By limiting the mating capabilities between respective connectors 10 and posts 100, a proper, optimum, reliable and safe electrical connection is ensured.

Referring to FIGS. 1 through 4, keying member 200 may be provided to ensure proper connection between respective connectors and posts. While connectors 4, 6, 8, 10 are shown, connectors 4, 6, 8, 10 are an illustrative embodiment and the claims are not intended to be limited to the embodiment of the connector shown and described. Another embodiment of such a connector system is shown in copending U.S. Provisional Patent Application Ser. No. 61/857,532 filed on Jul. 23, 2013, which is hereby incorporate by reference in its entirety.

As best shown in FIG. 3, each connector 4, 6, 8, 10 has a keying receiving relief or recess 86 which extends from the second or bottom end 18 of the body 12 of the connector 4, 6, 8, 10 toward the first or top end 16 of the body 12. In the embodiment shown, the keying receiving recess 86 is positioned proximate the post receiving passage 14 and extends about the circumference of the post receiving passage 14. The spacing of the receiving recess 86 from the post receiving passage 14 may vary, as will be further described below. Other embodiments of the keying receiving recess 84 may be used without departing from the scope of the invention.

Post 100 includes a bus mating end 106 which is positioned away from the top end 102. In the embodiment shown, a hex nut 108 is provided proximate the bus mating end 106 and extends about the circumference of the bus mating end 106. As best shown in FIG. 3, the nut 108 has a first surface 110 and an oppositely facing second surface 112. The first surface 110 cooperates with a substrate, circuit board, bus bar or other such component to properly seat the post 100. However, other configurations can be used without departing from the scope of the invention. A retaining recess 114 extends about the circumference of the mating end 106. The retaining recess 114 is spaced from the nut 108 in a direction toward the top end 102.

Plastic, insulative or isolating keying members 200 are positioned on posts 100. In FIG. 1, different keying members 200 are shown. Keying members 200 are representative embodiments which cooperate with connectors 4, 6, 8, 10 to ensure that only connectors with desired electrical properties/characteristics can be mated with respective posts with similar electrical properties/characteristics, as will be more fully described.

As best shown in FIGS. 3 and 4, keying members 200 have first ends 204 and second ends 206. The first ends 204 have recesses 205 which are dimensioned to cooperate with the second surfaces the nuts 108 when the keying members 200 are fully inserted onto posts 100. Keying projections 208 extend from the second ends 206 in a direction away from the first ends 204. An opening 210 is provided in each keying member 200. The openings 210 extend through the keying members 200 and the keying projections 208 to allow the posts 100 to be inserted therethrough. The keying projections 208 extend about, but are spaced from, the circumference of openings 210 at varying distances. Retaining members 212 are provided proximate the openings 210 to cooperate with recesses 114 of posts 100 to retain the keying members 200 of one of the posts 100.

In use, the connector system uses the keying members 200 to ensure that only connectors with desired electrical properties/characteristics can be mated with respective posts with similar electrical properties/characteristics, thereby ensuring that a safe and effective electrical connection between the connectors and the posts is affected.

The keying member 200 is inserted onto the post 100 prior to respective electrical connectors 4, 6, 8, 10 being mated to the post. The opening 210 accepts the post 100 therein and allows the keying member 200 to be inserted onto the post 100 toward the nut 108 of the post 100. As this occurs, the retaining member 212 of the keying member 200 is resiliently deformed. Insertion continues until the retaining member 212 engages the recess 114 of the post 100. As this occurs, the retaining member 212 moves toward an unstressed position, securing the retaining member 212 in the retaining recess 114 and thereby securing the keying member 200 to the post 100.

With the keying member 200 maintained on the post 100, a respective electrical connector 4, 6, 8, 10 is inserted onto the post 100. As this occurs, the post 100 is received in the post receiving passage 14. If the respective connector 4, 6, 8, 10 has the appropriate electrical characteristics/properties which correspond to the electrical characteristics/properties of the respective post 100, the keying projection 208 of the keying member 200 will align with the projection receiving recess 86 of the connector, allowing the connector to be fully mated with the post 100, as was previously described.

Alternatively, if the respective connector does not have the appropriate electrical characteristics/properties properties which correspond to the electrical characteristics/properties of the respective post 100, the keying projection 208 of the keying member 200 will not align with the projection receiving recess 86 of the connector, thereby preventing the connector from being fully mated with the post 100. This prevents the respective connector from being improperly inserted onto a post 100 with differing electrical characteristics/properties.

Many different configurations of the projection receiving recesses 86 and the keying projections 208 can be provided to accommodate for many different keying combinations. In order to provide for different combination, the projection receiving recesses 86 and the keying projections 208 may have, but are not limited to, different spacing, different shapes/configurations and/or different colors. In addition, multiple and/or different numbers projection receiving recesses 86 and keying projections 208 may be provided to facilitate further combinations.

The method of positioning a connector on a post, as described in the description above, includes: inserting a keying member onto the post; retaining the keying member on the post; inserting the connector onto the post; engaging the keying member with the connector; and properly seating the connector on the post if keying member properly mates with a keying receiving recess of the connector. The keying member ensures that only a connector with desired electrical characteristics is mated to a post with similar electrical characteristics ensuring that a proper, reliable and safe electrical connection is provided.

Prior to inserting the keying member onto the post, the colors of the locking release button 50 (or other parts of the connector) and the color coded keying projections 208 may be visually checked to make certain that they match, thereby ensuring that only proper connectors are inserted on proper posts 100. With the colors properly matched, the respective keying projection 208 can be properly and fully positioned in a corresponding respective receiving recess 86, thereby ensuring that only proper respective connectors are mated on proper respective posts 100.

The connector, system and method described herein provides a simple and reliable connection to mating posts and to the power bus to which the posts are connected. The connector is inserted onto the post making an electrical connection thereon. The use of the keying member ensures that only connectors with desired electrical characteristics are mated to posts with similar electrical characteristics ensuring that a proper, optimum, reliable and safe electrical connection is ensured.

If the keying projection 208 and the projection receiving recess 86 of the connector 4, 6, 8, 10 properly align or mate and the connector 4, 6, 8, 10 is properly inserted onto the post 100, the use of the locking release member 50 ensures that the connector is fully inserted onto the post, thereby ensuring that a positive electrical connection is provided and maintained. The visual indication provides a quick and cost effective means to confirm that the connection is secured.

The configuration of the connector, the post and the keying member allows for the connector to be inserted onto the post from any direction.

Referring to FIGS. 9 through 13, an alternate exemplary embodiment is shown. In this embodiment, the connector 310 and post 400 are essentially identical to the connectors 10 and posts 100 described and shown with respect to FIGS. 1 through 8, therefore a detailed explanation of the parts and operation of the connectors 310 and posts 400 will not be repeated except where the connector 310 and post 400 depart from the teaching of connectors 10 and posts 100.

Figure 10:
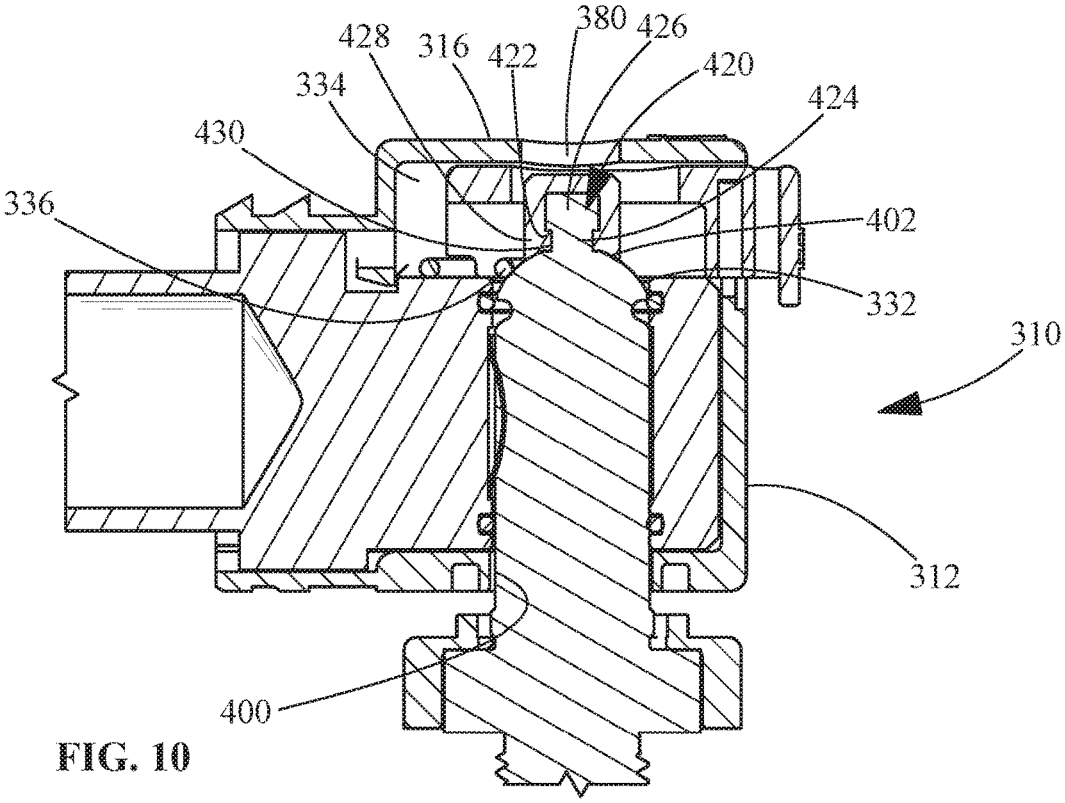
FIG. 10 is a cross-sectional view of the quick connect power connector of FIG. 9, illustrating the quick connect power connector prior to being fully mated to a mating post.
Figure 12:
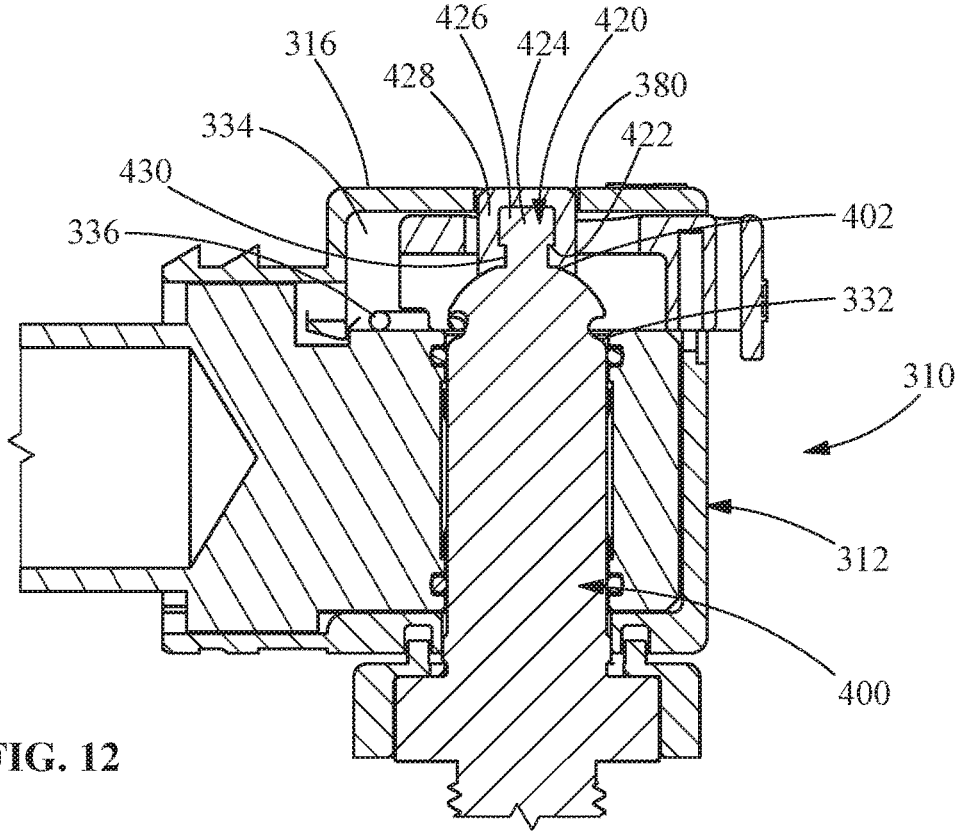
FIG. 12 is a cross-sectional view of the quick connect power connector of FIG. 11, illustrating the quick connect power connector in the latched or locked position.
Figure 13:
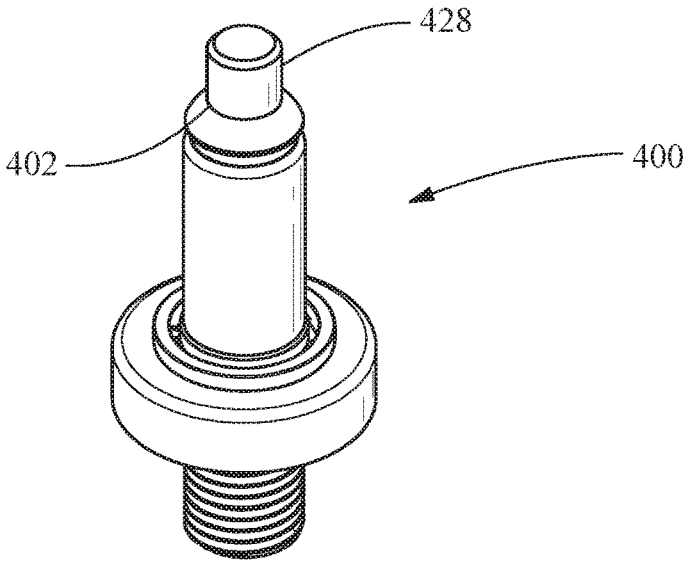
FIG. 13 is a perspective view of the mating post with a mating indicator positioned thereon.

As best shown in FIGS. 10 and 12, post 400 includes a mating projection 420 which extends the top surface 402 of the post 400. In the illustrative embodiment, the mating projection 420 has a shoulder 422 which extends between a neck portion 424 and a head portion 426. However, other embodiments of the mating projection 420 may be used without departing from the scope of the invention. A mating indicator 428 is positioned on the top of post 400. In the illustrative embodiment shown, the mating indicator 428 is a molded around the post 400, such that the shoulders 422 cooperate with projections 430 of the mating indicator 428 to retain the mating indicator 428 in position relative to the mating projections 420 and the post 400. However, other methods of applying the mating indicator 428 to the mating projections 420 and other methods of retaining the mating indicator 428 to the mating projection 420 can be used without departing from the scope of the invention. In the embodiment shown, the mating indicator 428 is made from plastic or other nonconductive material. The mating indicator 428 may be colored or textured to be more visible, as will be more fully described.

Connector 310 has an opening 380 which extends from the first or top end 316 of the connector body 312 to the locking release cavity 334. The opening 380 is dimensioned to receive the mating indicator 428 therein when the connector 310 is fully mated to the post 400.

Figure 9:
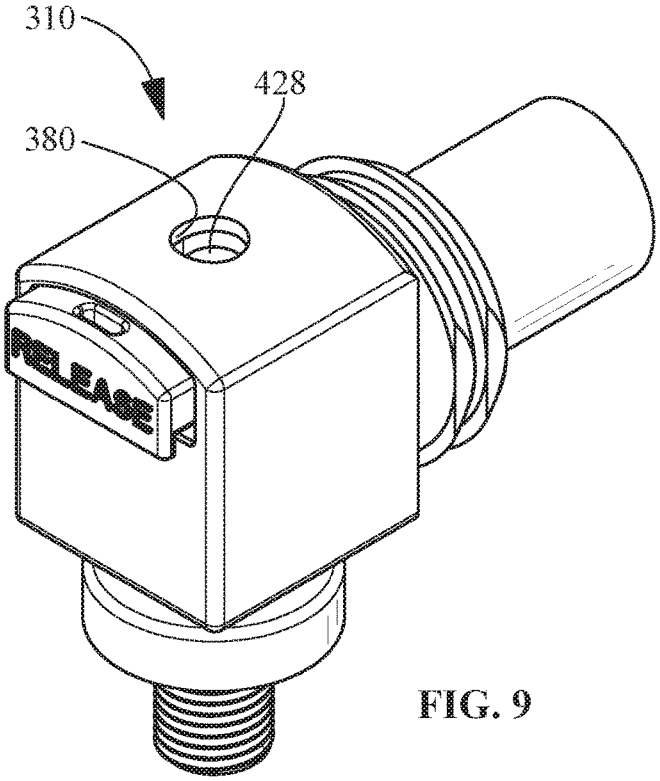
FIG. 9 a perspective view of an alternate illustrative embodiment of a quick connect power connector prior to being fully mated to a mating post.

As the post 400 is inserted into the post receiving passage 314, the top end 402 of post 400 moves through opening 332 and resiliently deforms locking spring member 366, allowing the top surface 402 of the post 400 to move beyond the locking spring member 366. As this occurs, the mating indicator 428 is not yet received in opening 380, thereby providing a visual indication that the connector 310 is not fully mated to the post 400, as shown in FIGS. 9 and 10.

Figure 11:
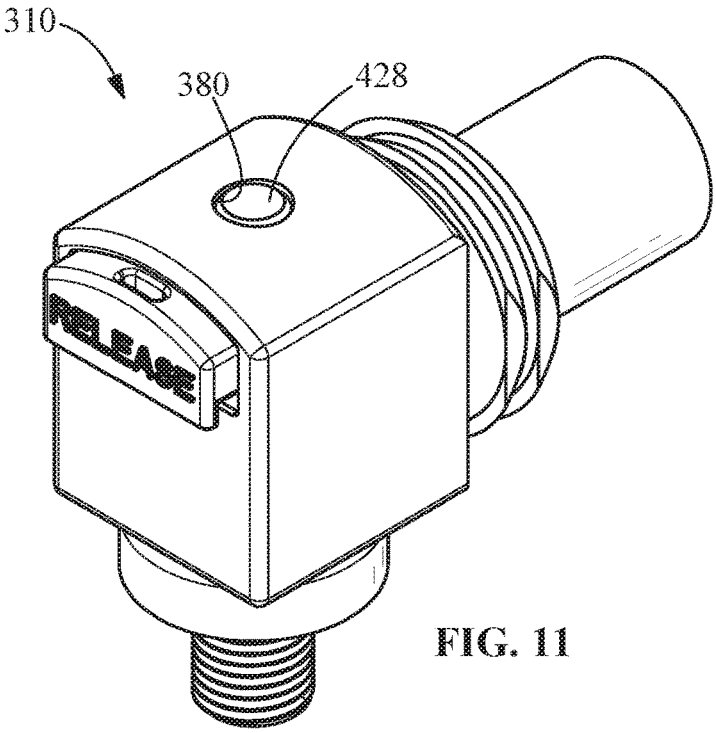
FIG. 11 is a perspective view of the alternate illustrative embodiment of the quick connect power connector of FIG. 9 in the latched or locked position.

When the pin 400 is fully inserted into the connector 312, a top portion of the mating indicator 428 is positioned in the opening 380 of the top end 316 of the connector body 312, thereby providing a visual indication that the connector 310 is fully mated to the post 400, as shown in FIGS. 11 and 12.

FIGS. 14 through 19 illustrate another illustrative embodiment of a connector 510 and post 600 which is similar to that shown in FIGS. 9 through 13. Post 600 includes a mating indicator 628 which is attached to post 600 as described with reference to post 400. In the embodiment shown the mating indicator 628 is made from plastic or other nonconductive material. The mating indicator 628 may be colored or textured to be more visible, as will be more fully described. The mating indicator 628 has a recess or groove 630 which extends about the circumference thereof.

Figure 14:
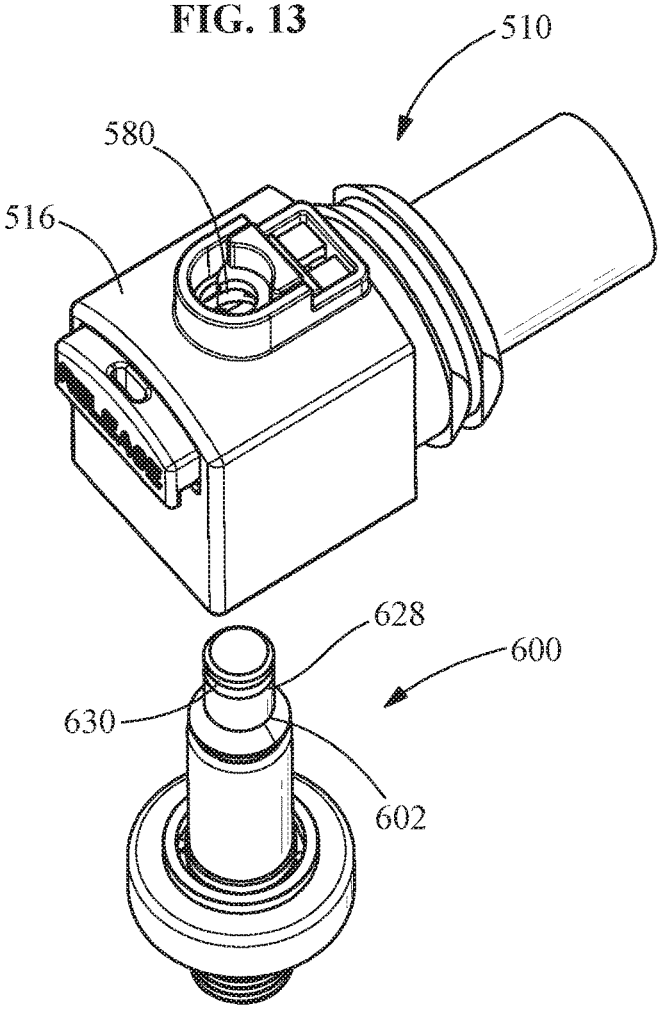
FIG. 14 is a perspective view of another alternate illustrative embodiment of a quick connect power connector with a secondary lock prior to being fully mated to a mating post.

Connector 510 has an opening 580 which extends from the first or top end 516 of the housing or connector body 512 to the locking release cavity 534. The opening 580 is dimensioned to receive the mating indicator 628 therein when the connector 510 is fully mated to the post 600. A secondary locking member 582 is positioned proximate the opening 580. The secondary locking member 582 has an upper portion 584 with a post locking member 586 and an engagement member 588. The secondary locking member 582 has a lower portion 590 with a securing member 592. The secondary locking member 582 is moveable between a first or open position, as shown in FIG. 14 and a second or locked position, as shown in FIG. 15.

As best shown in FIGS. 16 through 19, the lower portion 590 of the secondary locking member 582 extends below the top end 516 of the housing or connector body 512 while the upper portion 584 extends above the top end 516 of the housing or connector body 512. A neck or reduced portion 594 extends between the upper portion 584 and the lower portion 590. The neck 594 is positioned in a slot 596 provided in the top end 516 of the connector body 512 proximate the opening 580. The slot 596 is dimensioned to receive the neck 594 while allowing the neck 590 and the secondary locking member 582 to move in a direction parallel to a longitudinal axis of the top end 516 of the connector body 512. The upper portion 584 and the lower portion 590 are positioned on either side of the top end 516, thereby preventing the movement of the secondary locking member 582 in a direction perpendicular to the longitudinal axis of the top end 516.

As the post 600 is inserted into the post receiving passage 514, the top end 602 of post 600 moves through connector body 512, as previously described with respect to FIGS. 9 through 13. As this occurs, the mating indicator 628 is not yet received in opening 580, thereby providing a visual indication that the connector 510 is not fully mated to the post 600. As the insertion continues, the secondary locking member 582 is retained in the first or open position, as shown in FIG. 14, thereby allowing the post 600 to move into opening 580.

When the pin 600 is fully inserted into the connector body 512, a top portion of the mating indicator 628 is positioned in and extended through the opening 580 of the top end 516 of the connector body 512, thereby providing a visual indication that the connector 510 is fully mated to the post 600. In this embodiment, the top portion of the mating indicator 628 extends through the opening to expose the groove 630. With the pin 600 fully inserted, the engagement member 588 of the secondary locking member 582 is moved toward the post 600, thereby causing the secondary locking member 582 to move to the second or locked position, as shown in FIG. 15, in which the post locking member 586 is positioned in the recess 630 of the post 600. In this position, the post engagement member 584 is received in the groove 630 of the post 600, thereby preventing the removal of the post 600 from the connector 510 and maintaining the connector 510 is proper position on the post 600.

Figure 20:
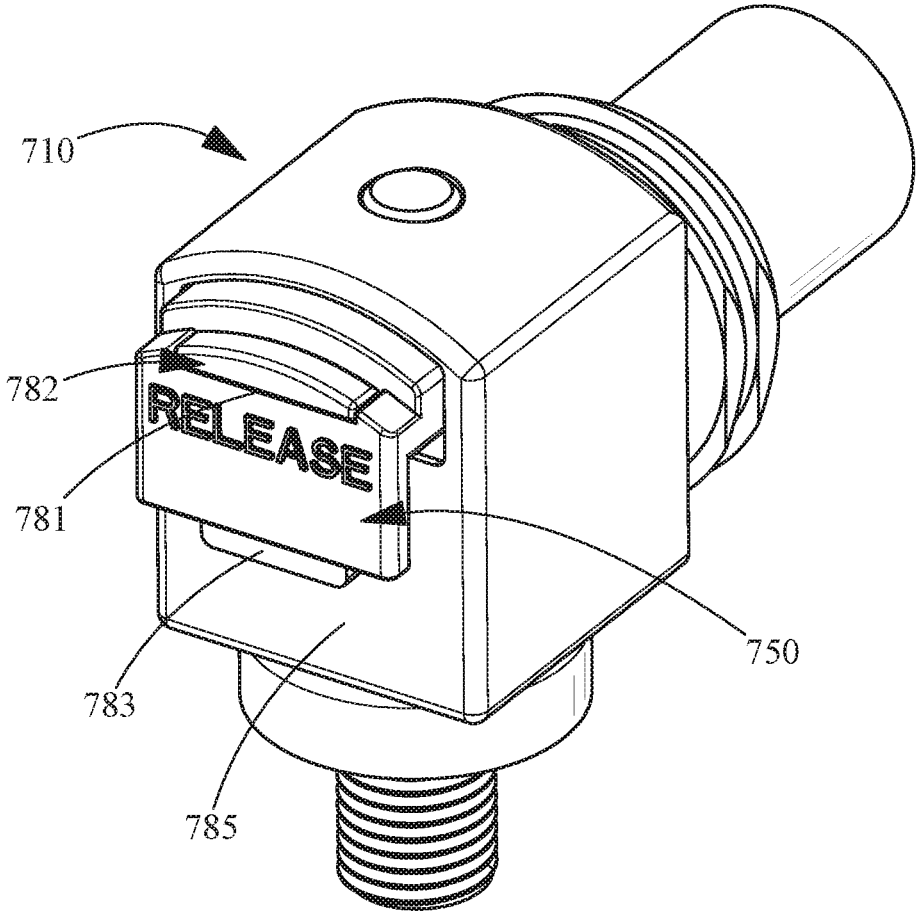
FIG. 20 is a perspective view of another alternate illustrative embodiment of a quick connect power connector with an alternate secondary lock prior in an open or unlocked position.
Figure 21:
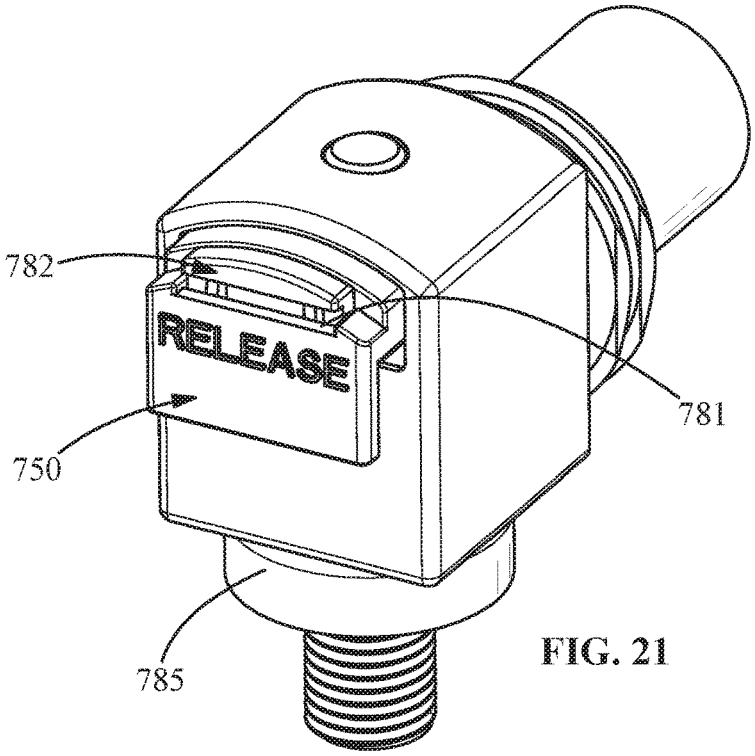
FIG. 21 is a perspective view of the alternate illustrative embodiment of the quick connect power connector of FIG. 20 in the latched or locked position.

An alternate secondary locking member 782 is shown in FIGS. 20 and 21. In this embodiment, the locking release member 750 has a slot 781 into which secondary locking member 782 is positioned. The secondary locking member 782 is moveable between a first or open position, as shown in FIG. 20 and a second or locked position, as shown in FIG. 21. In the open position, a stop member 783 of the secondary locking member 782 is positioned below the locking release member 750, thereby allowing the locking release member 750 to be moved to allow the insertion of the post into the connector, as previously described with respect to FIGS. 1 through 8. In the locked position, the stop member 783 is positioned between the locking release member 750 and a back wall 785 of the connector 710, thereby preventing the locking release member 750 from being depressed toward the back wall 785, thereby preventing the removal of the post from the connector 710 and maintaining the connector 710 is proper position on the post. Alternatively, the stop member 783, locking release member 750 and features on the back wall 785 of the connector 710 could be configured such that the open position and locked positions described would be reversed. In this embodiment, FIG. 20 shows the open position, allowing the connector to be mated and unmated and FIG. 21 shows the closed position, preventing the removal of the post from the connector 710.

Figure 22:
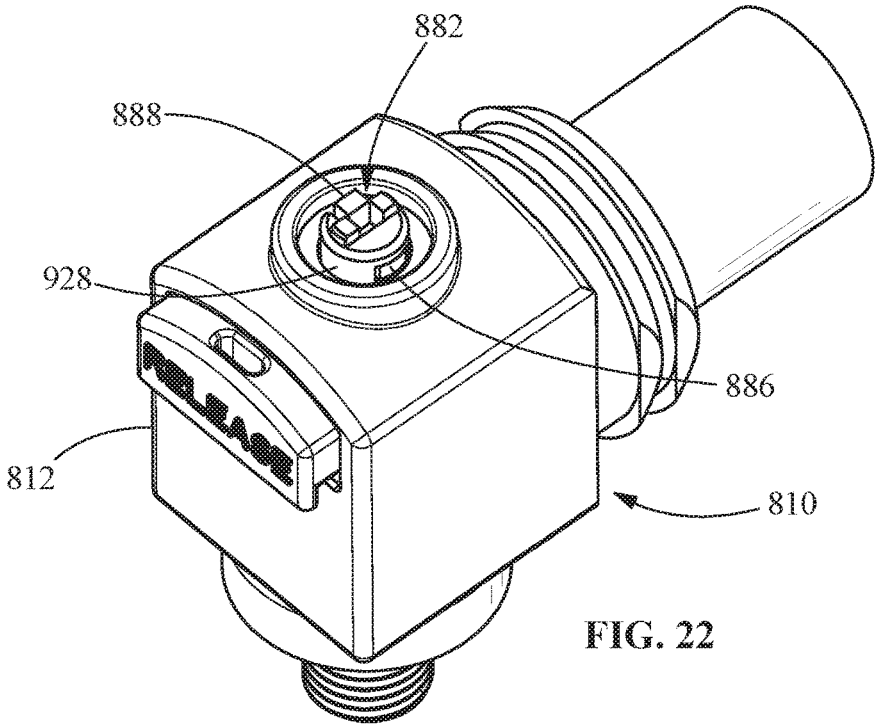
FIG. 22 is a perspective view of another alternate illustrative embodiment of a quick connect power connector with an alternate secondary lock prior in an open or unlocked position.
Figure 23:
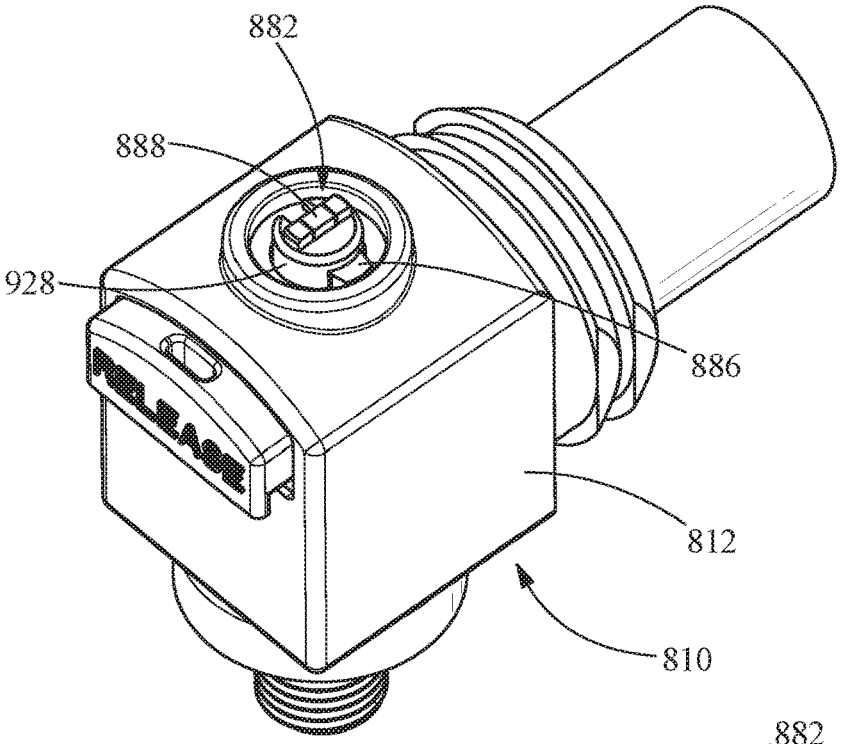
FIG. 23 is a perspective view of the alternate illustrative embodiment of the quick connect power connector of FIG. 22 in the latched or locked position.
Figure 24:
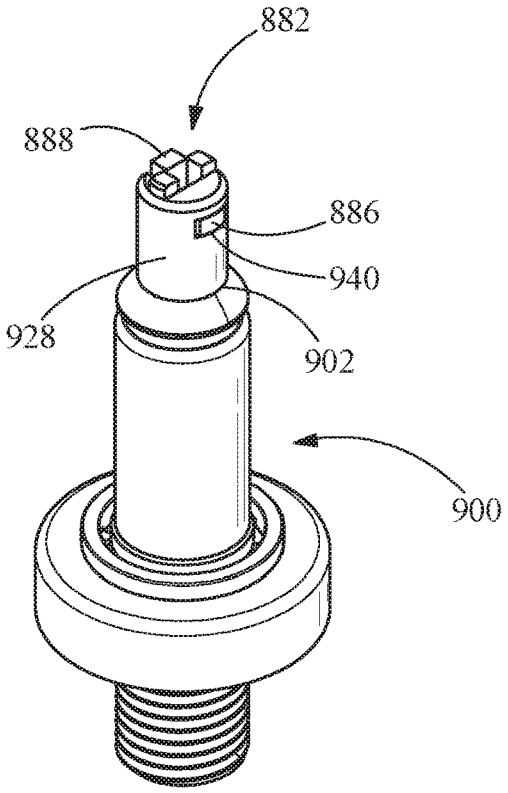
FIG. 24 is a perspective view of a post with the secondary lock of FIG. 22 positioned thereon.
Figure 25:
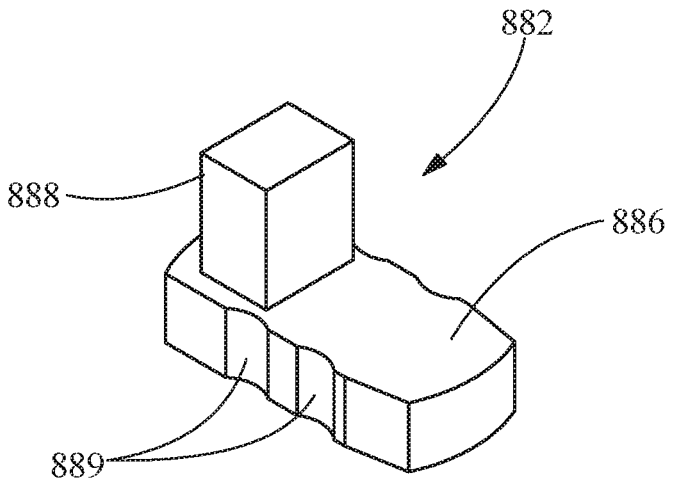
FIG. 25 is a perspective view of the locking mechanism of the secondary lock of FIG. 22.

An alternate secondary locking member 882 is shown in FIGS. 22 through 25. In this embodiment, the secondary locking member 882, which is positioned on post 900, is moveable between a first or open position, as shown in FIG. 22 and a second or locked position, as shown in FIG. 23. The secondary locking member 882, as best shown in FIG. 25 has a post locking member 886 and an engagement member 888.

As shown in FIGS. 22 through 24, the secondary locking member 882 is positioned in a slot 940 provided in the mating indicator 928 at the top end 902 of post 900. As the post 900 is inserted into the post receiving passage, the top end 902 of post 900 moves through connector body 812, as previously described with respect to FIGS. 9 through 13. As this occurs, the secondary locking member 882 is maintained in the slot 940 of the mating indicator 928. As no portion of the secondary locking member 882 extends beyond the perimeter of the mating indicator 928, the presence of the secondary locking member 882 does not inhibit the insertion of the post 900 into the connector 810.

When the pin 900 is fully inserted into the connector body 812, a top portion of the mating indicator 928 is positioned in and extends through the opening 880 of the top end 816 of the connector body 812, thereby providing a visual indication that the connector 810 is fully mated to the post 900. In this embodiment, the top portion of the mating indicator 928 extends through the opening to expose the secondary locking member 882. With the pin 900 fully inserted, the engagement member 888 of the secondary locking member 882 is moved toward the longitudinal center of the post 900, thereby causing the secondary locking member 882 to move to the second or locked position, as shown in FIG. 23, in which the post locking member 886 engages or is positioned proximate to the top end 816 of the connector 812, thereby preventing the removal of the post 900 from the connector 810 and maintaining the connector 810 is proper position on the post 900.

Figure 26:
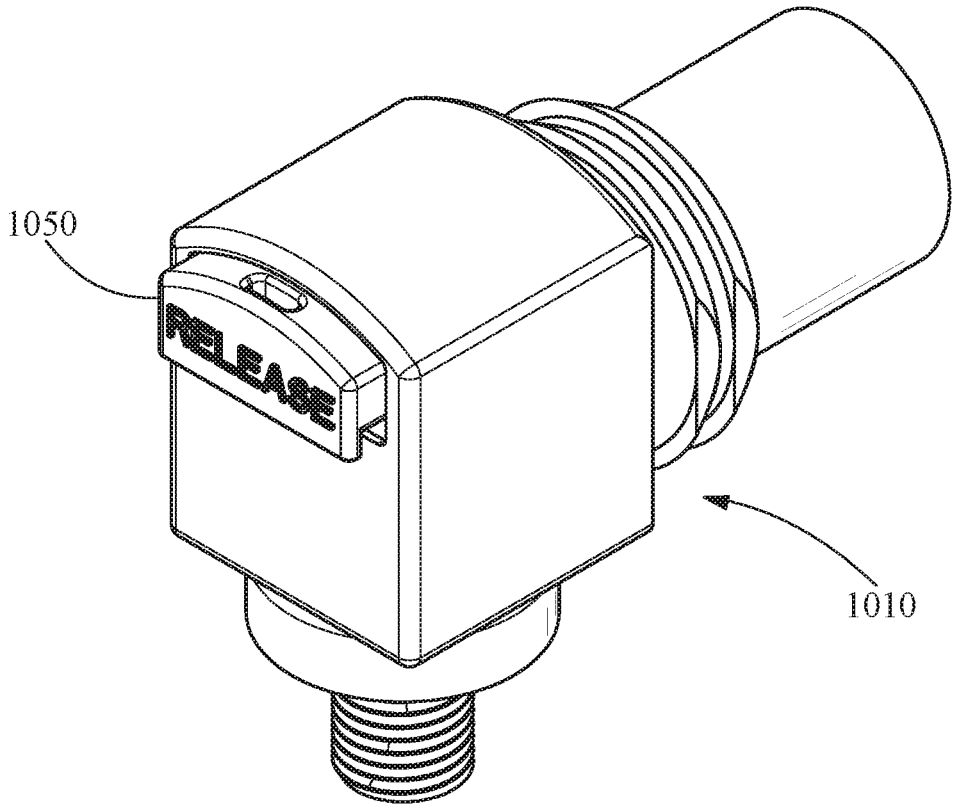
FIG. 26 is a perspective view of another alternate illustrative embodiment of a quick connect power connector with an alternate secondary lock prior to an open or unlocked position.
Figure 27:
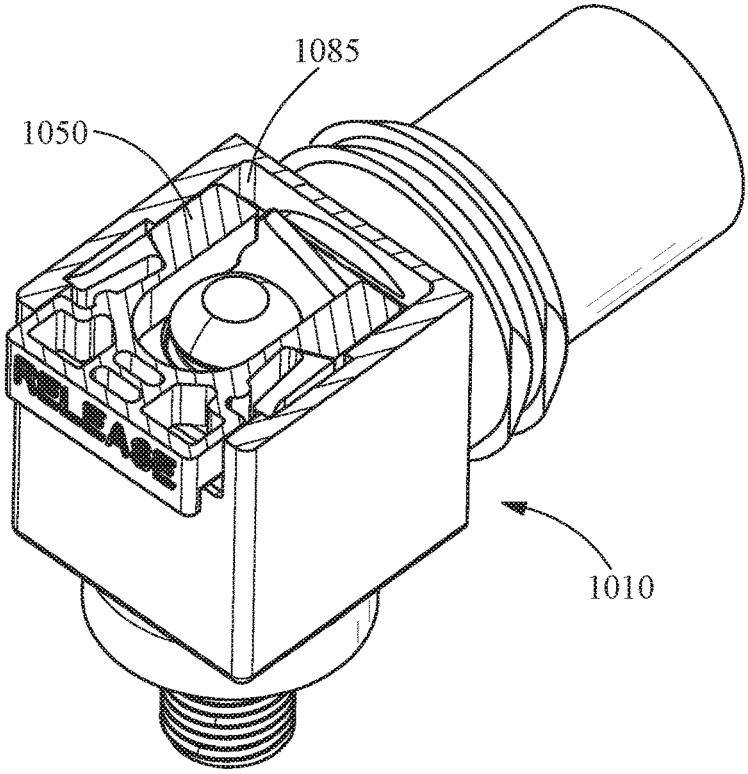
FIG. 27 is a partial cutaway perspective view of the quick connect power connector of FIG. 26 showing the alternate secondary lock prior in the open or unlocked position.

Other alternative secondary locking members may be used without departing from the scope of the invention. As an example, FIGS. 26 and 27 illustrate a component 1085 which is positioned in the path of the locking release member 1050. Such a component 1085 may be activated to prevent the locking release member 1050 from being unintentionally depressed when the connector 1010 is fully inserted on the post.

Figure 28:
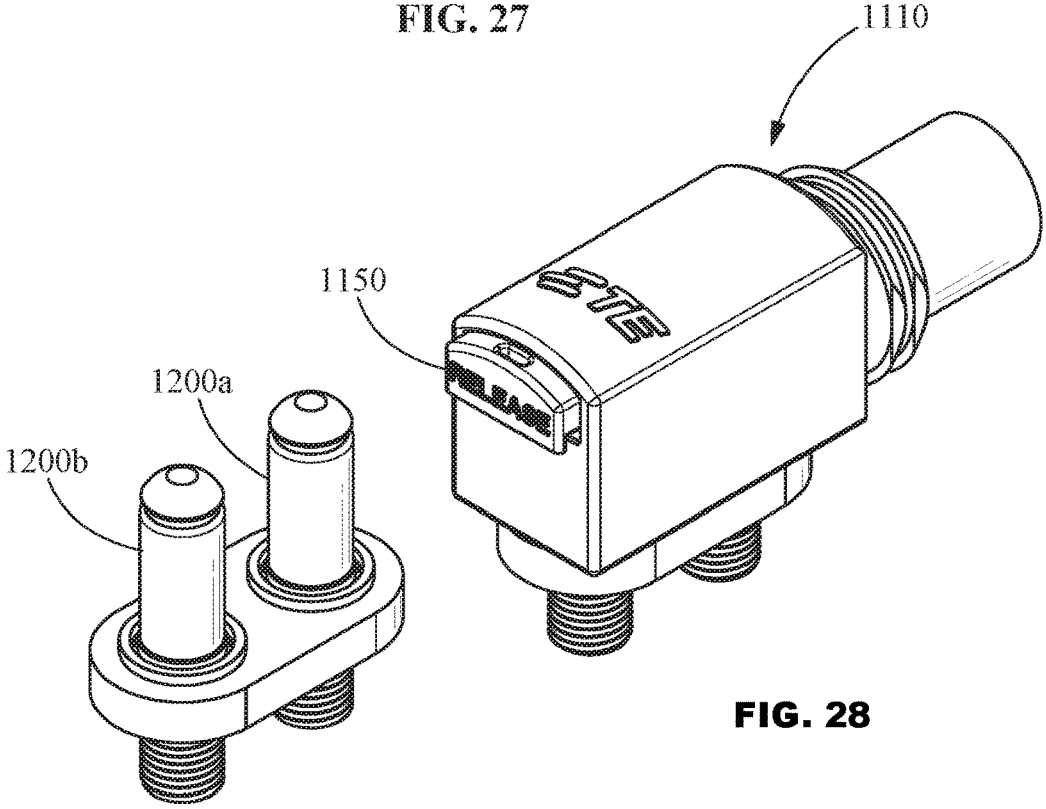
FIG. 28 is a perspective view of another alternate illustrative embodiment of a quick connect power connector shown with mounting to two posts.
Figure 29:
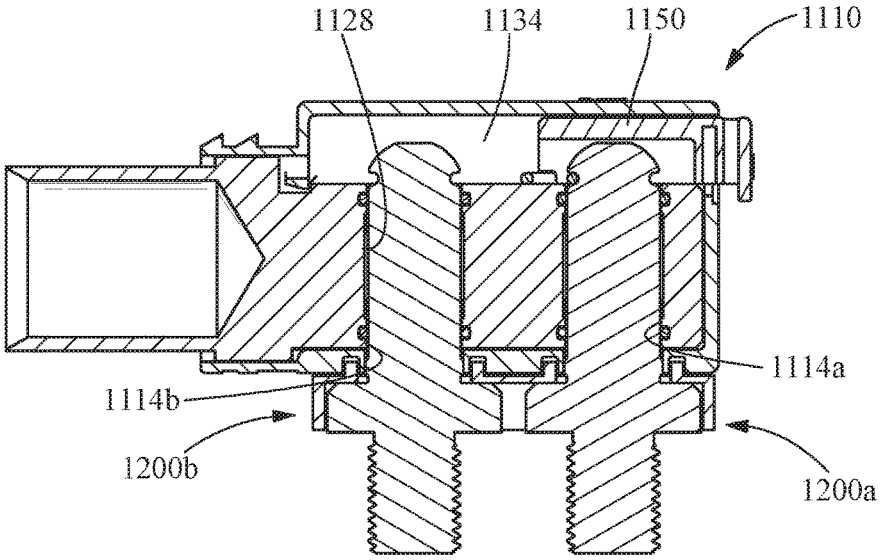
FIG. 29 is a cross-sectional view of the quick connect power connector of FIG. 28, illustrating the quick connect power connector in the latched or locked position.

A quick connect power connector 1110 for use with two posts 1200 is shown in FIGS. 28 and 29. In this illustrative embodiment, the connector 1110 is enlarged to include two post receiving passages 1114. The first post receiving passage 1114*a* is provided in line with the locking release member 1150 provided in the cavity 1134. The operation of the locking release member 1150 and the post 1200*a* is identical to that described with respect to other embodiments and will not be repeated herein. The post 1200*b* is inserted into second post receiving passage 1114*b* as shown in FIG. 29. In the illustrative embodiment shown, the post 1200*b* is inserted into second post receiving passage 1114*b* but does not cooperate with the locking release member 1150. However, other embodiments in which the post 1200*b* cooperates with some type of locking release member may be used without departing from the scope of the invention.

By providing two or more post receiving passages 1114 in the connector 1110, redundancy is provided between the contact 1128 of the connector 1110 and the posts 1200*a*, 1200*b*. This allows for a more reliable interconnection and allows for a higher current rating for the connector. In addition, the cooperation of the post receiving passages 1114*a*, 1114*b* with respect posts 1200*a*, 1200*b* provides stability to the connector 1110. With two or more posts 1200 inserted into respective post receiving passages 1200, the connector 1110 is maintained in a desired orientation and is not able to rotate. As rotation of the connector is not desired in certain applications, the use of the multiple posts 1200 and multiple post receiving passages 1114 can be used to prevent such rotation.

Figure 30:
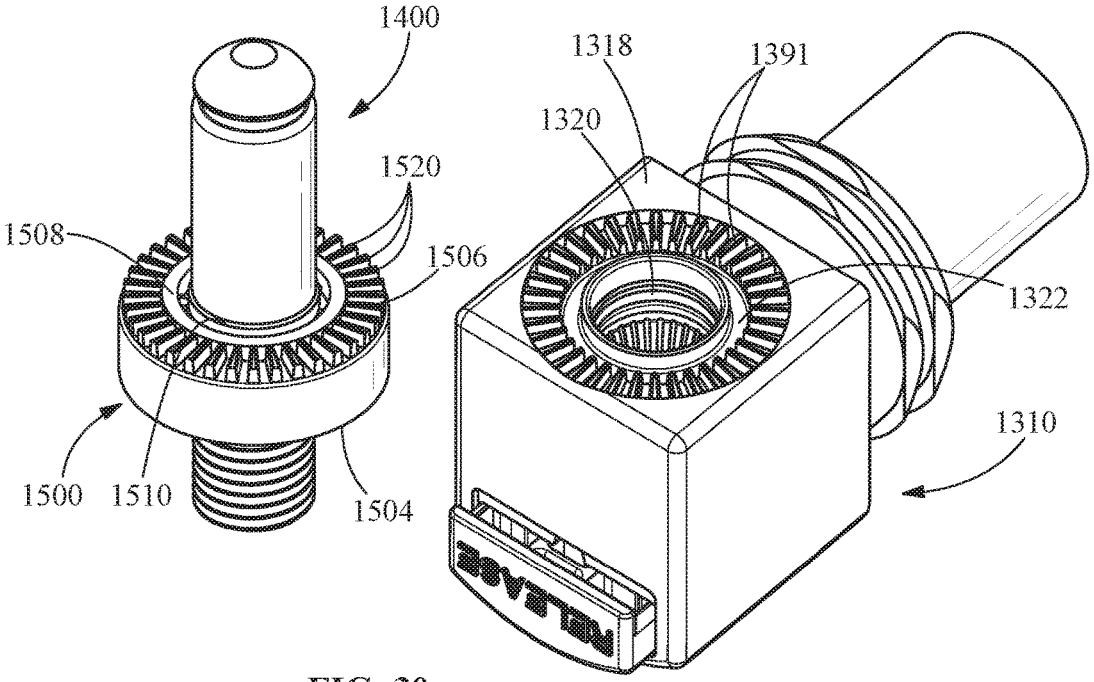
FIG. 30 is a perspective view of another alternate illustrative embodiment of a quick connect power connector shown prior to mounting to a post, the connector and the post have anti-rotation ribs provided thereon.
Figure 31:
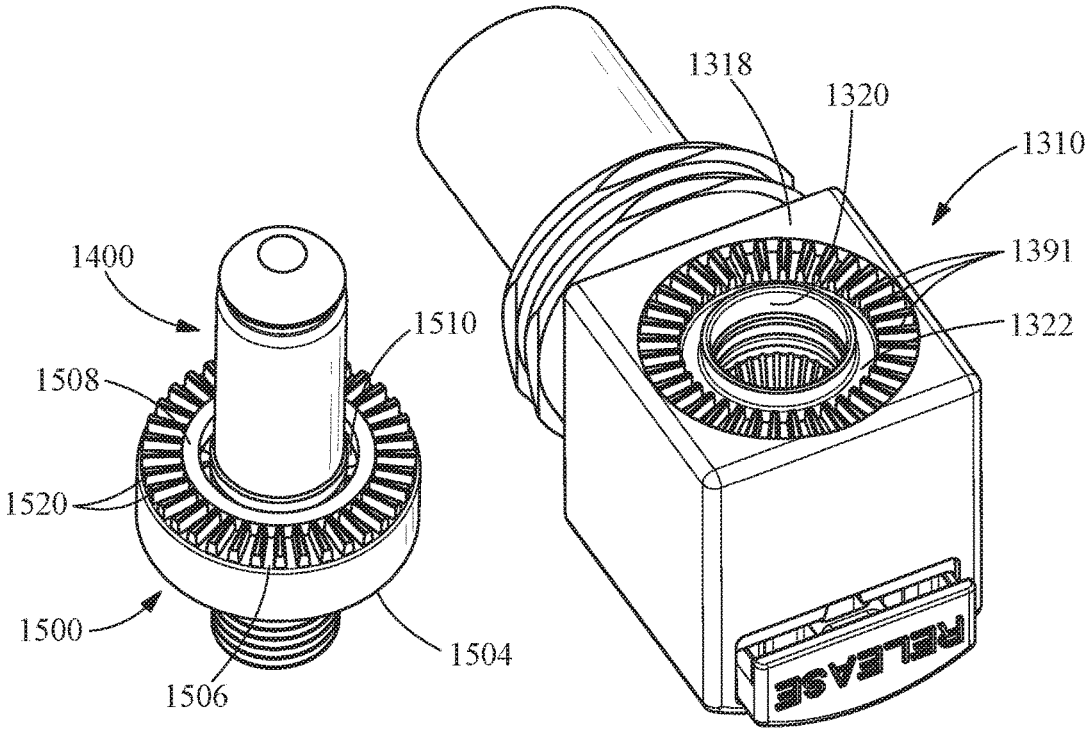
FIG. 31 is a perspective view of a quick connect power connector, similar to that shown in FIG. 30 with a different keying feature, shown prior to mounting to a post, the connector and the post have anti-rotation ribs provided thereon.
Figure 32:
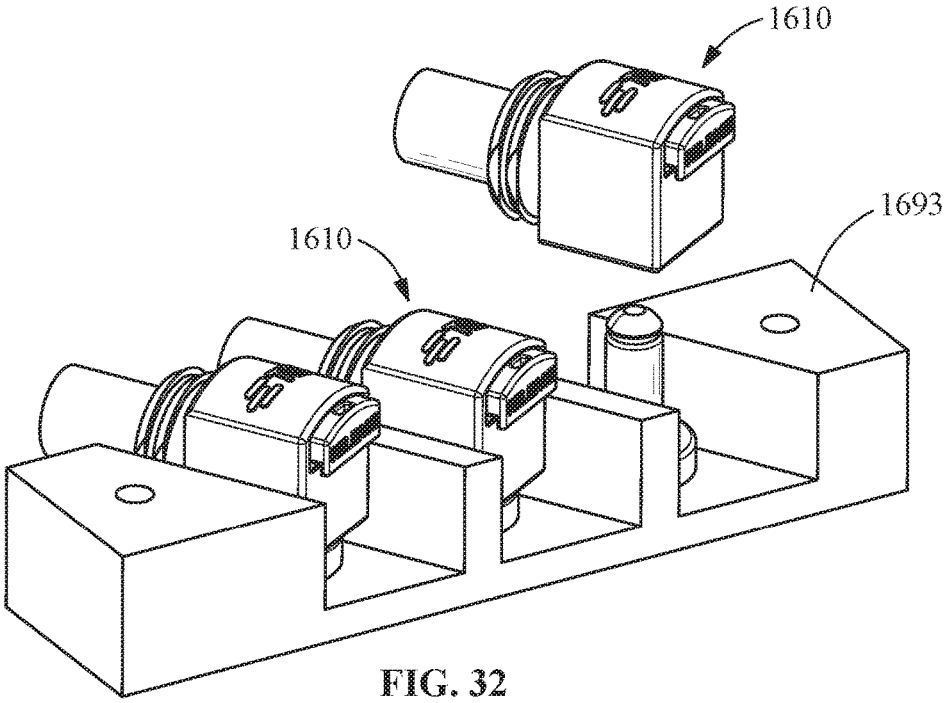
FIG. 32 is a perspective view of another alternate illustrative embodiment a quick connect power connector showing an anti-rotation feature cooperating with the connectors.

In instances where only one post 1400 is appropriate or practical with the connector 1310, other types of anti-rotation devices may be used, as shown in FIGS. 30 through 32. Although rotation of the connectors is desirable in certain applications, other applications required the connector interface to be stabilized and predictable. Consequently, in some illustrative embodiments, it is beneficial to minimize or eliminate the effects of movement of the connector caused by shock, vibration and/or torqueing of the connector by tension on the power cable, etc.

Referring to FIGS. 30 and 31, radial ribs 1391 are positioned on the post receiving end 1318 of the connector 1310. The ribs 1391 extend outward from the circumferences of the opening 1320. Circular key receiving recesses 1322 intersect the ribs 1391. The key receiving recesses 1322 extend about, but are spaced from, at varying distances, the circumference of the opening 1320.

Keying members 1500 have keying projections 1508 extend from the second ends 1506 in a direction away from the first ends 1504. An opening 1510 is provided in each keying member 1500. The opening 1510 extends through the keying members 1500 and the keying projections 1508 to allow the posts 1400 to be inserted therethrough. Radial ribs 1520 are positioned on the second end 1506 of the keying member 1500. The ribs 1520 extend outward from the circumferences of the opening 1510. The circular keying projections 1508 intersect the ribs 1520. The keying projections 1508 extend about, but are spaced from, at varying distances, the circumference of the opening 1510.

In the embodiment shown, the ribs 1391, 1520 are shown at 10 degree intervals, but other spacing may be provided. When the connector 1310 is mated to the keying member 1500, respective keying projections 1508 are positioned in key receiving recesses 1322. As this occurs, the ribs 1391 are received in the spaces between ribs 1520, and the ribs 1520 are received in the spaces between ribs 1391. As this occurs, the ribs 1391 and the ribs 1520 are positioned proximate to or in engagement with each other, thereby preventing the rotation of the connector 1310 relative to the keying member 1500 and relative to the post 1400.

Another example of an anti-rotation feature is shown in FIG. 32. In this embodiment, projections 1693 extend between connectors 1610 and cooperate with side walls of the connectors to prevent the rotation of the connectors 1610 relative to the posts. Such projections can be provided at any angle to accommodate the orientation desired.

Figure 33:
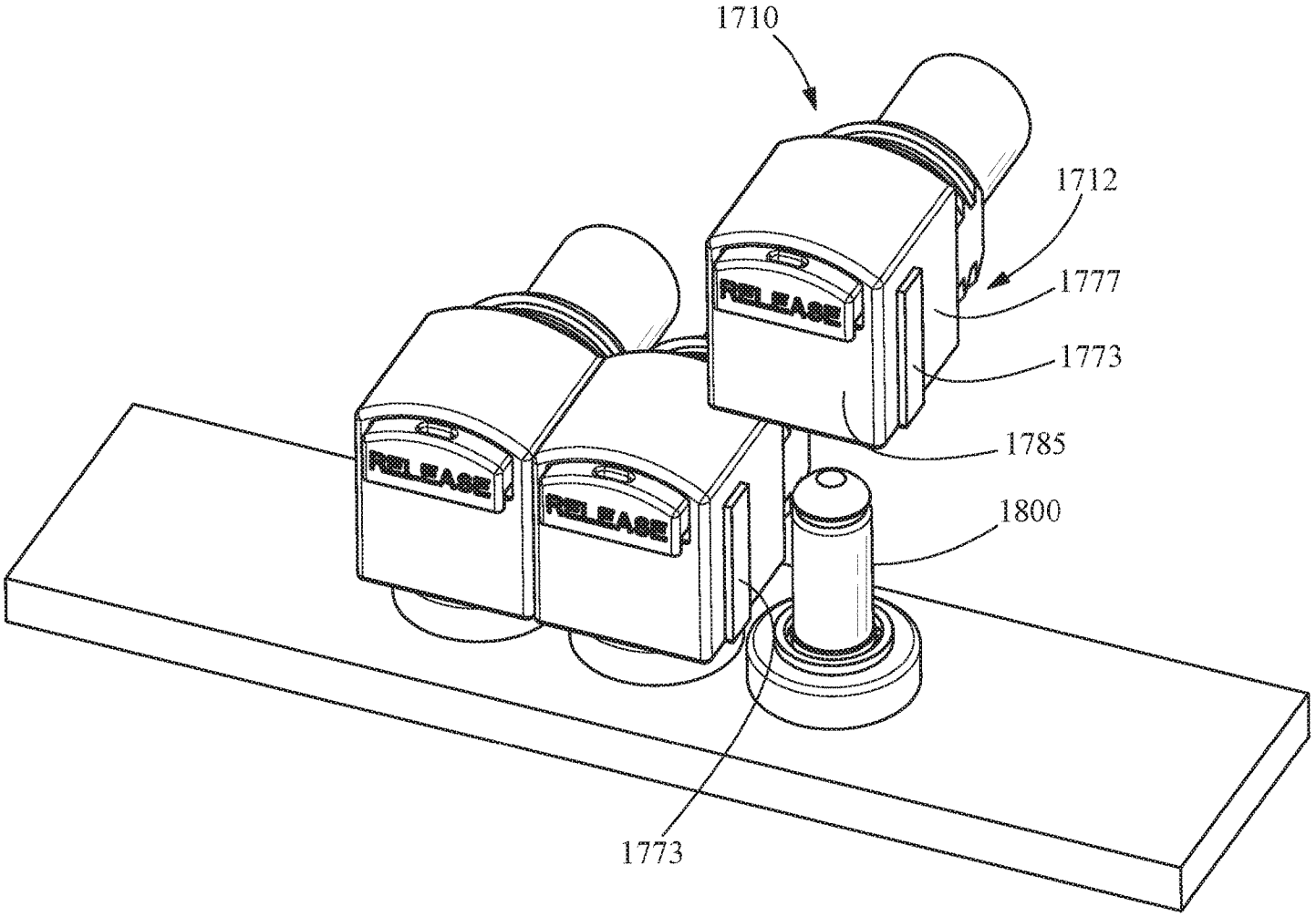
FIG. 33 is a perspective view of another alternate illustrative embodiment of a quick connect power connector showing an anti-rotation feature.
Figure 34:
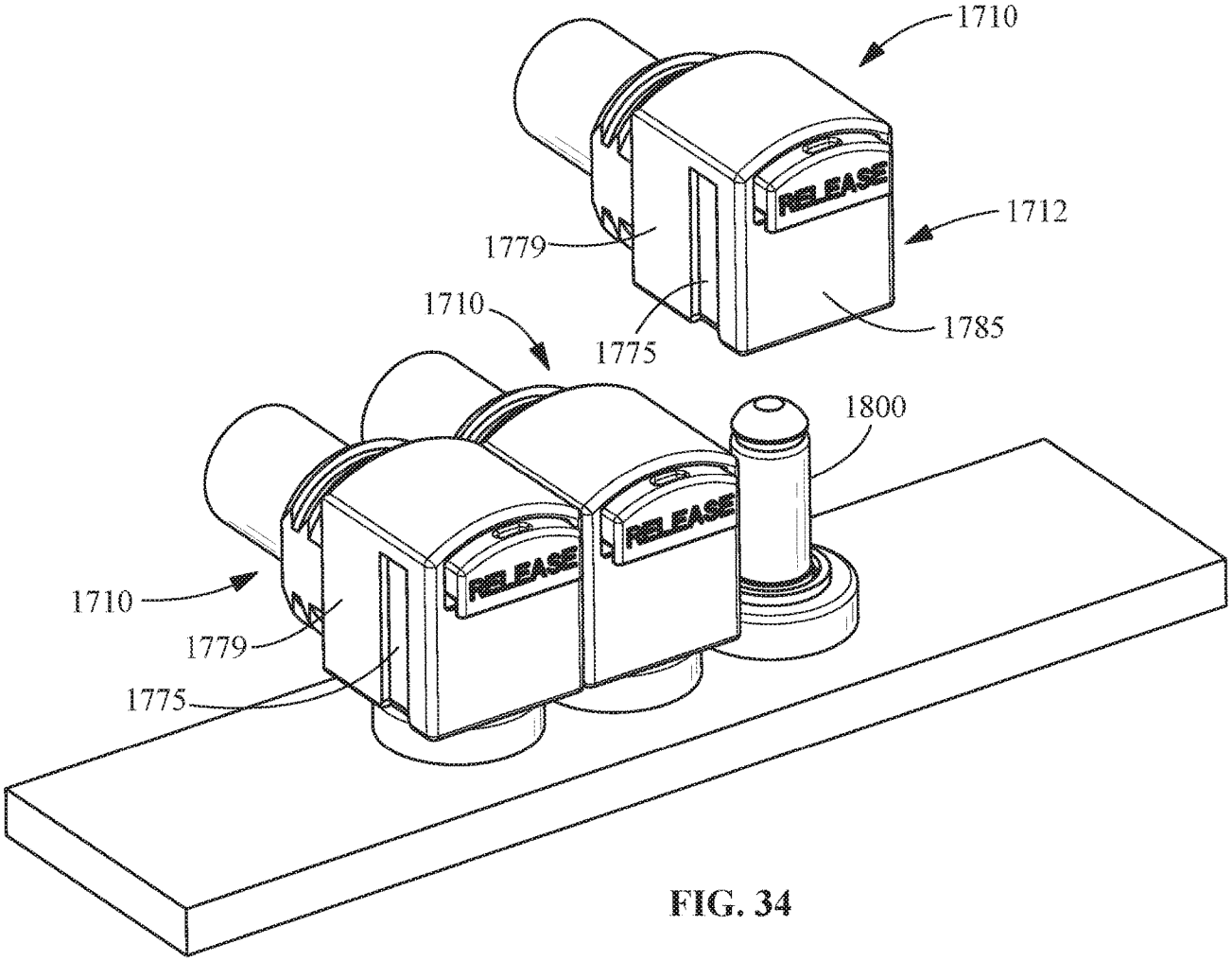
FIG. 34 is an alternate perspective view of the connector shown in FIG. 33.

Another example of an anti-rotation feature is shown in FIGS. 33 and 34. In this embodiment, projections 1773 extend from side walls 1777 of connector housings 1712 of connector 1710. Recesses 1775 are provided in side walls 1779 of connector housings 1712 of connector 1710. The projections 1773 and recesses 1775 are provided on opposite side walls 1777, 1779. The projections 1773 and recesses 1775 are positioned on the respective sidewalls and equal distance from the back walls 1785, such that when the connectors 1710 are positioned on the posts 1800, projections 1773 of one connector 1710 align with recesses 1775 of the adjacent connector 1710. The posts 1800 are spaced apart such that when adjacent connectors 1710 are inserted onto the posts 1800, the projection 1773 of one connector will be received in the recess 1775 of the adjacent connector, essentially locking the connector 1710 together, thereby preventing the rotation of the connectors 1710 relative to each other and relative to the posts 1800.

Figure 35:
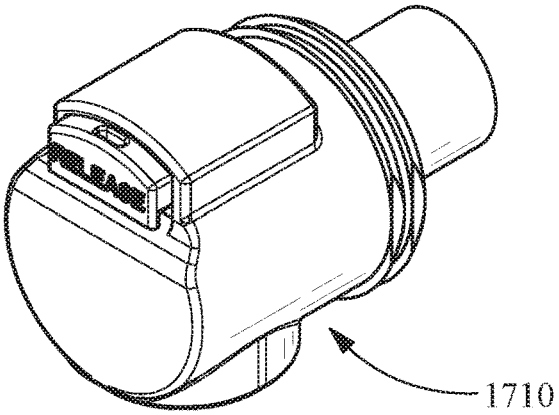
FIG. 35 is a perspective view of another illustrative embodiment of a quick connect power connector according to the present invention shown prior to mounting to a mating connector or post, the quick connect power connector and the mating post are dimensioned to accommodate high current flow.
Figure 35:
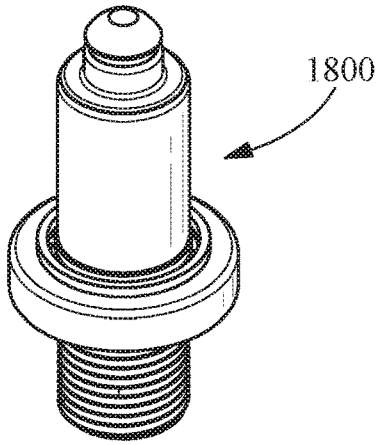
Figure 36:
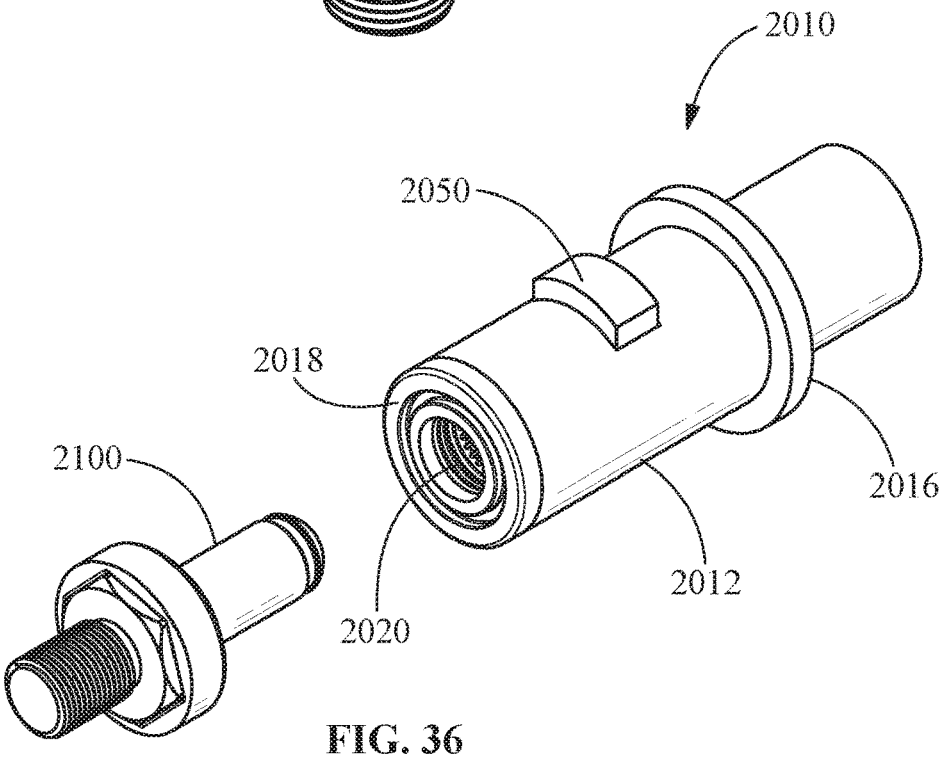
FIG. 36 is a perspective view of an illustrative embodiment of an in-line quick connect power connector according to the present invention shown prior to mounting to a mating connector or post.
Figure 37:
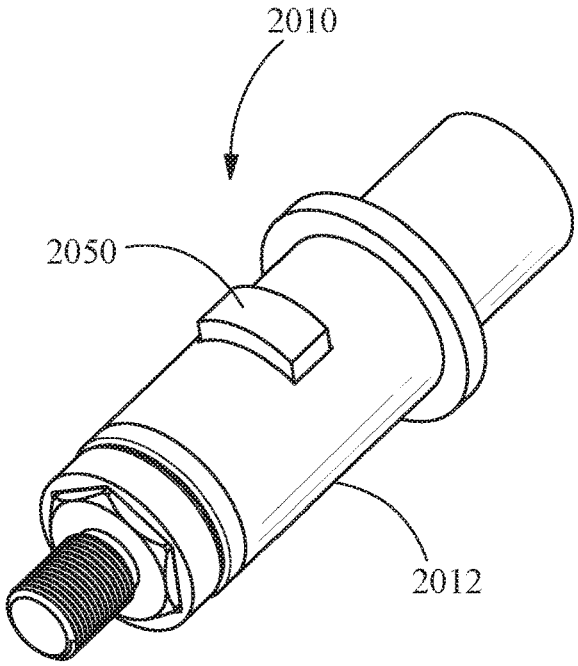
FIG. 37 is a perspective view of the in-line quick connect power connector of FIG. 36 shown mated to the post.

Referring to FIG. 35, the connector 1710 and post 1800 may be sized to accommodate a higher current rating. In the embodiment shown, the post and connector are sized to accommodate 500 amps or more.

FIGS. 36 through 40 illustrate an in-line connector with similar features as the embodiments described above. Each in-line connector 2010 has a housing body 2012 with a post receiving passage 2014 for receiving a respective post 2100 therein. The connector 2010 has a first or top end 2016 and an oppositely facing second or bottom end 2018 which has an opening 2020 to receive the post 2100 therethrough. The opening 2020 extends to the post receiving passage 2014. A conductor or wire receiving member 2022 extends through the first end 2016. A conductor or wire (not shown) is inserted into a conductive wire receiving member 2022 and is terminated thereto by crimping or other known termination methods. In the embodiment shown, the conductive wire receiving member 2022 is a separate member made from conductive material.

A contact 2028 (FIGS. 38 and 40) is positioned in the post receiving passage 2014. In the embodiment shown, the contact 2028 is a band which extends around the circumference of the passage 2014. The band has resilient contact arms which extend into the passage 2014. As the post 2100 is inserted into the passage 2014, the contact arms 2030 are resiliently deformed and are placed in electrical contact with the post 2100. The contact 2028 is positioned in the passage 2014 such that the contact 2028 will be placed in electrical engagement/contact with the post 2100 regardless of the orientation of the contact 2028 with respect to the post 2100. The conductor and wire provided in the wire receiving member 2022 are electrically connected to the contact 2028 using known methods of termination. While the contact 2028 is shown in the form of a band, other types of contacts can be used without departing from the scope of the invention.

Figure 38:
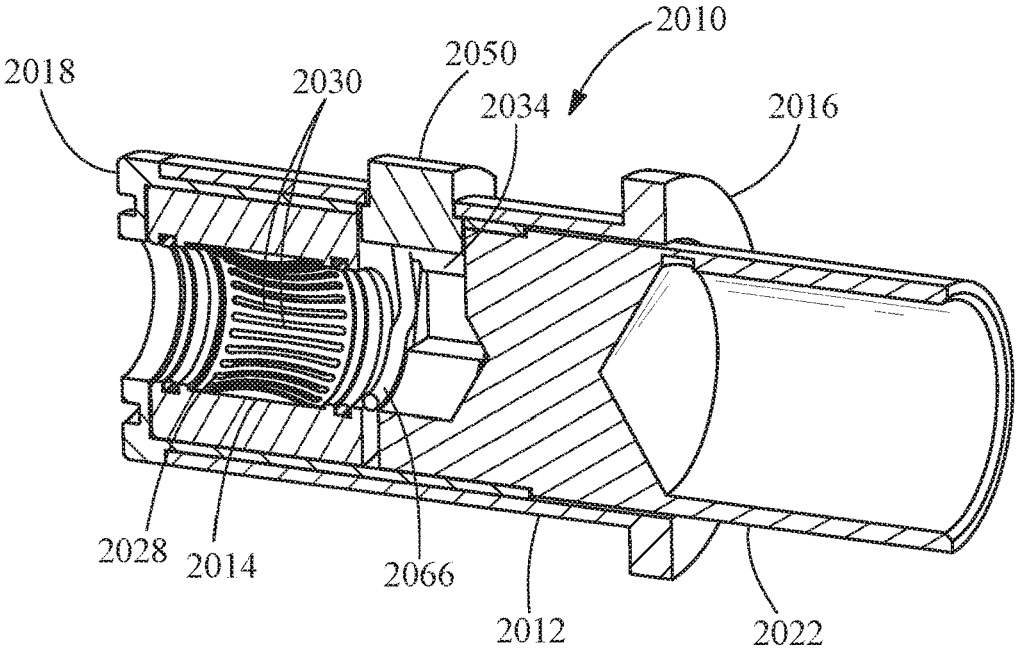
FIG. 38 is a longitudinal cross sectional view of the in-line quick connect power connector of FIG. 36.
Figure 39:
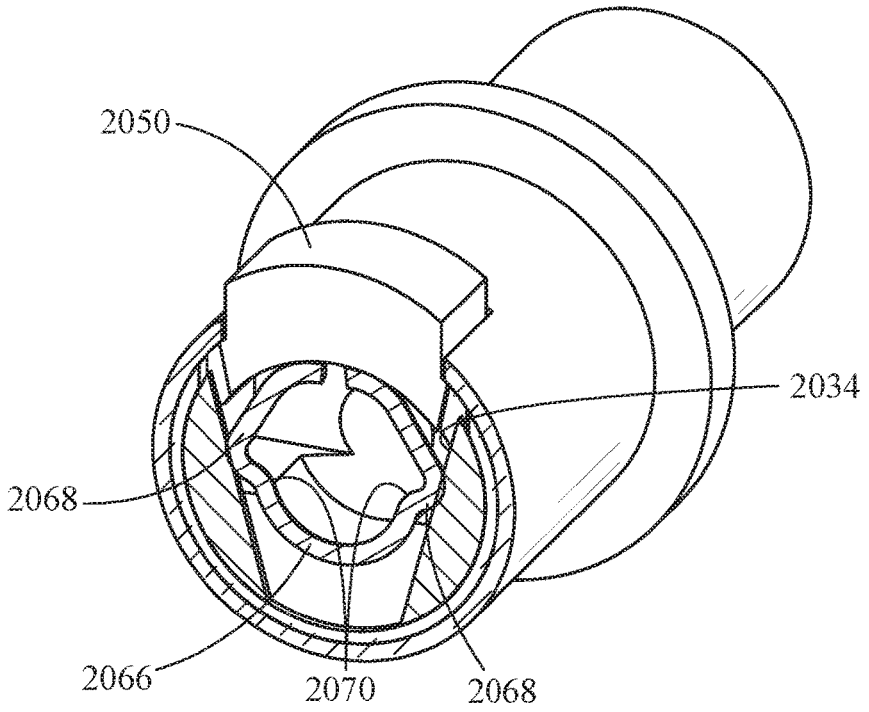
FIG. 39 is a transverse cross sectional view of the in-line quick connect power connector of FIG. 36.
Figure 40:
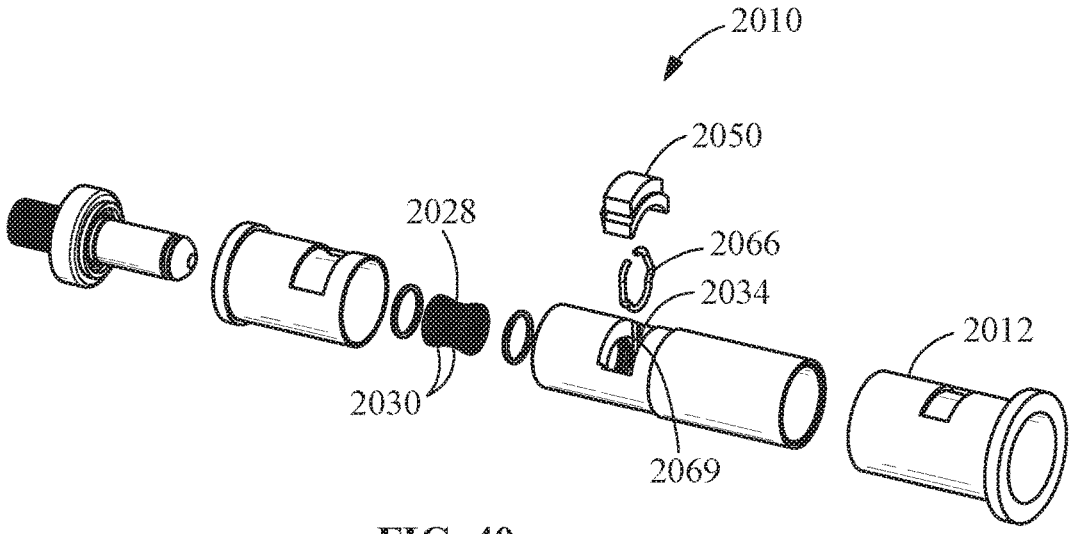
FIG. 40 is an exploded perspective view of the in-line quick connect power connector assembly of FIG. 36.
Figure 41:
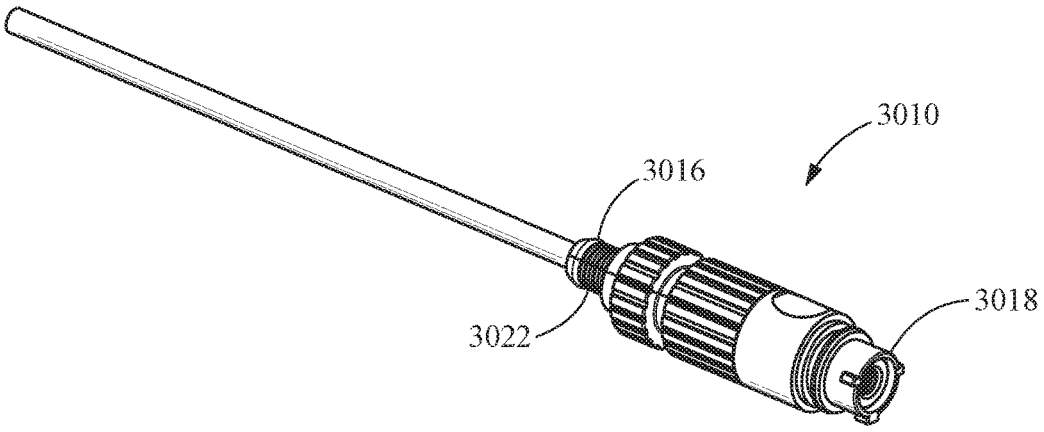
FIG. 41 is a perspective view of an illustrative embodiment of a rotational bayonet latching power connector according to the present invention shown prior to mating to a panel.
Figure 42:
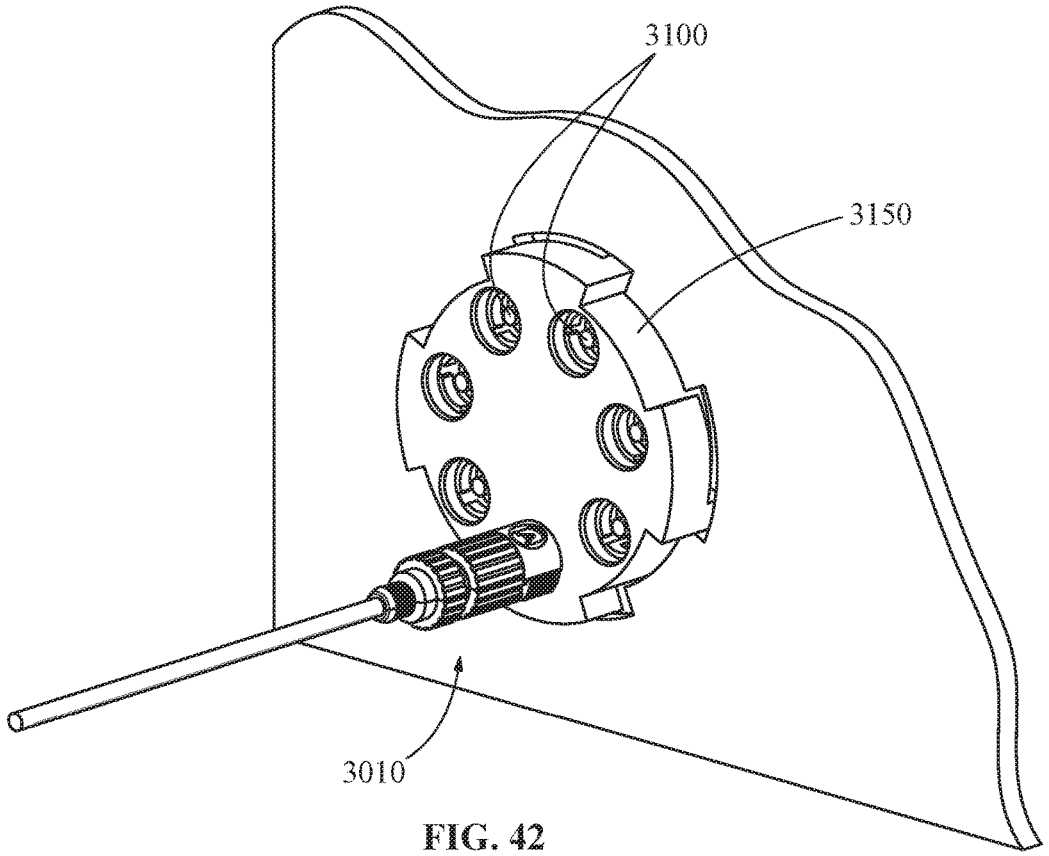
FIG. 42 is a perspective view of the rotational bayonet latching power connector of FIG. 41 shown prior to being mated to a panel.

A locking release cavity 2034 (as best shown in FIGS. 38 through 40) is provided proximate the end of contact 2028. A locking release member 2050 is positioned in the cavity 2034. The locking release member 2050 is movably mounted in the cavity 2034 of connector body 2012.

A locking spring member 2066 is housed in the cavity 2034 and cooperates with the release member 2050. The locking spring member 2066 may be retained in the cavity 2034 by known securing techniques. As best shown in FIG. 38, the locking spring member 2066 has a pair of mounting sections 2068 which are positioned in recess 2069. Proximate the sections 2068 are locking sections 2070 which have a radiused locking surface which cooperates with the post 2100, as will be more fully described.

When the connector 2010 is mated with the mating post 2100, the post 2100 is received within the post receiving passage 2014 of the connector 10. While the configuration of the connector 2010 and the locking spring member 2066 are different than the connector 10 and spring member 66 described with respect to FIGS. 1 through 8, the operation of the connector 2010 and connector 10 are very similar and will not be repeated. In summary the locking spring member 2066 is moved between the first or open position and the second or locked position in a manner similar to the previously described embodiments.

Figure 43:
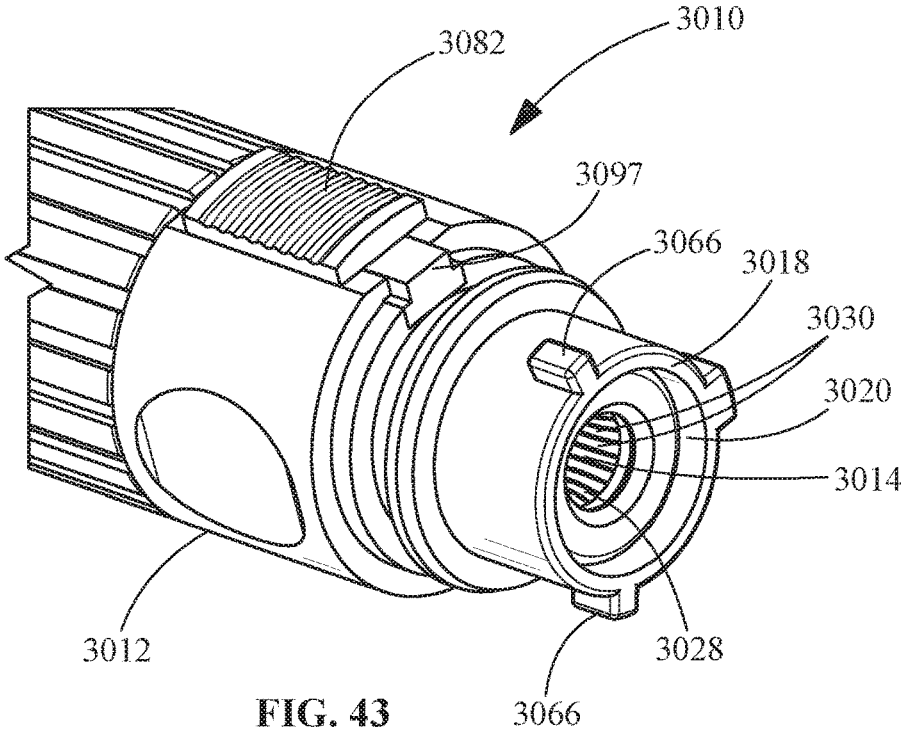
FIG. 43 is an enlarged perspective view of the rotational bayonet latching power connector of FIG. 41.

FIGS. 41 through 44 shows a quick connect rotational bayonet power connector 3010. As best shown in FIG. 43, the connector 3010 has a housing body 3012 with a post receiving passage 3014 for receiving a respective post 3100 therein. The connector 3010 has a first end 3016 and an oppositely facing second end 3018 which has an opening 3020 to receive the post 3100 therethrough. The opening 3020 extends to the post receiving passage 3014. A conductor or wire receiving member 3022 extends through the first end 3016. A conductor or wire (not shown) is inserted into a conductive wire receiving member 3022 and is terminated thereto by crimping or other known termination methods. In the embodiment shown, the conductive wire receiving member 3022 is a separate member made from conductive material.

A contact 3028 (FIG. 43) is positioned in the post receiving passage 3014. In the embodiment shown, the contact 3028 is a band which extends around the circumference of the passage 3014. The band has resilient contact arms which extend into the passage 3014. As the post 3100 is inserted into the passage 3014, the contact arms 3030 are resilient deformed and are placed in electrical contact with the post 3100. The contact 3028 is positioned in the passage 3014 such that the contact 3028 will be placed in electrical engagement/contact with the post 3100 regardless of the orientation of the contact 3028 with respect to the post 3100. The conductor and wire are electrically connected to the contact 3028 using known methods of termination. While the contact 3028 is shown in the form of a band, other types of contacts can be used without departing from the scope of the invention.

Figure 44:
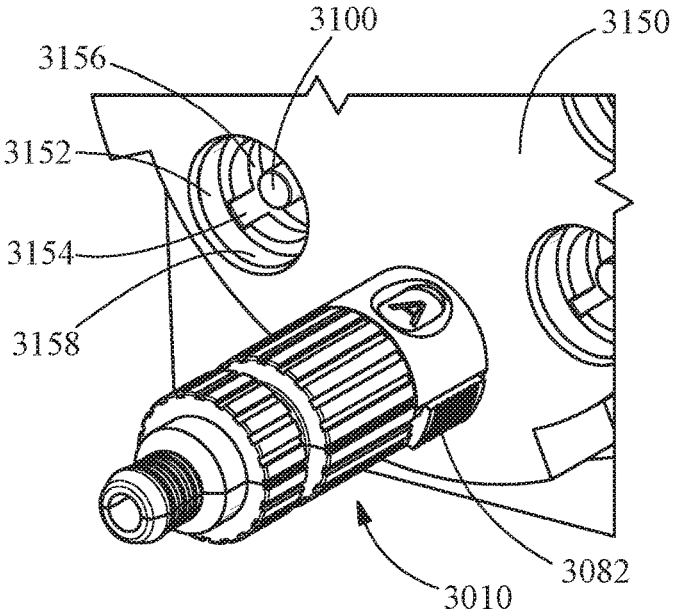
FIG. 44 is an enlarged perspective view of the rotational bayonet latching power connector of FIG. 41 and the panel.

Locking projections 3066 extend from proximate the second end 3018 of the housing body 3012. A secondary locking member 3082 is also provided in the housing body 3012 proximate to but spaced from the second end 3018 and the locking projections 3066. As best shown in FIG. 44, each post 3100 is retained in a panel 3150 or other similar member. A connector receiving recess 3152 extends about each post 3100. Each connector receiving recess 3152 has locking projection receiving recesses 3154 and a locking recess 3156 which extends about at least a portion of the perimeter of the connector receiving recess 3152.

In the embodiment shown, the wire conductor 3022 and/or contacts 3028 are mounted to allow the housing 3012 to rotate independently thereof. As the wires can be of a large size, the independent rotation of the housing allows the user to rotate the housing to make the connection to the panel 3150 without the need to twist the wire to a specific orientation.

When mating the connector 3010 with the post 3100, the connector 3010 is moved into engagement with the panel 3150 such that the locking projections 3066 are positioned in line with the locking projection receiving recesses 3154. Continued insertion causes the locking projections 3066 to be moved through the locking projection receiving recesses 3154 and into the locking recess 3156. With the locking projections 3066 fully moved into the locking recess 3156, the connector 3010 can be rotated, causing the locking projections 3066 to be moved out of alignment with the locking projection receiving recesses 3154, thereby preventing the withdraw of the connector 3010 from the connector receiving recess 3152 until the connector 3010 is rotated back such that the locking projections 3066 are positioned in line with the locking projection receiving recesses 3154.

With the connector 3010 properly mated to the post 3100 and maintained in the connector receiving recess 3152, the secondary locking member 3082 may be moved toward the panel 3150. Movement of the secondary locking member 3082 continues until a leading edge 3097 of the secondary locking member 3082 engages a shoulder 3158 of the connector receiving recess 3152. In this position, the secondary locking member 3082 prevents the unwanted rotation and removal of the connector 3010 from the connector receiving recess 3152 and the post 3100.

While various embodiments have been shown with the connectors having only one circuit therein, connectors with more than one circuit can be used.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector system for connecting an electrical connector to a terminal post, the electrical connector system comprising:

the electrical connector having a housing body with a post receiving passage for receiving the terminal post therein;

a contact provided in the post receiving passage, the contact positioned about the circumference of the post receiving passage wherein the contact will make an electrical engagement with the terminal post inserted into the post receiving passage regardless of the orientation of the terminal post with respect to the contact;

a locking release member moveably mounted to the housing body, the locking release member being moveable between a locking release member first position and a locking release member second position, the locking release member cooperating with a locking spring member, the locking spring member having a locking section which cooperates with a first recess of the terminal post when the locking release member is in the locking release member first position; and a secondary lock member positioned above the locking spring member, the secondary lock member being movable between a secondary lock member open position and a secondary lock member locked position, the secondary lock member having a post locking member which cooperates with a second recess of the terminal post to prevent the unwanted disengagement of the connector from the terminal post when the second lock member is in the secondary lock member locked position.

2. The electrical connector system as recited in claim 1, wherein the secondary locking member has an upper portion with the post locking member and an engagement member, the secondary locking member has a lower portion with a securing member.

3. The electrical connector system as recited in claim 2, wherein the lower portion of the secondary locking member extends below a top end of the housing body and the upper portion extends above a top end of the housing body.

4. The electrical connector system as recited in claim 3, wherein a reduced portion of the secondary locking member extends between the upper portion and the lower portion, the reduced portion is positioned in a slot provided in the top end of the housing body proximate an opening, the slot is dimensioned to receive the reduced portion while allowing the reduced portion and the secondary locking member to move in a direction parallel to a longitudinal axis of the top end of the connector body.

5. The electrical connector system as recited in claim 2, wherein the upper portion and the lower portion are positioned on either side of a top end of the housing body, thereby preventing the movement of the secondary locking member in a direction perpendicular to the longitudinal axis of the top end.

6. The electrical connector system as recited in claim 1, wherein an anti-rotation device is provided to minimize or eliminate the effects of movement of the connector relative to the terminal post.

7. The electrical connector system as recited in claim 6, wherein the anti-rotation device includes radial ribs positioned on a post receiving end of the housing body, the ribs extend outward from the circumferences of the post receiving passage, circular key receiving recesses intersect the ribs.

8. The electrical connector system as recited in claim 1, wherein the terminal post includes a mating projection which extends from a top surface of the terminal post, a mating indicator is positioned on the mating projection, wherein when the terminal post is fully inserted into the housing body, a top portion of the mating indicator is positioned in an opening of a top end of the housing body to provide a visual indication that the connector is fully mated to the terminal post.

9. The electrical connector system as recited in claim 8, wherein the mating projection has a shoulder which extends between a neck portion and a head portion, the shoulder cooperates with a projection of the mating indicator to retain the mating indicator in position relative to the terminal post.

10. The electrical connector system as recited in claim 8, wherein the mating indicator is made from nonconductive material.

11. An in-line electrical connector for connecting to a terminal post, the in-line electrical connector comprising:

a housing body having a post receiving passage for receiving the terminal post therein;

a contact provided in the post receiving passage, the contact positioned about the circumference of the post receiving passage wherein the contact will make an electrical engagement with terminal posts inserted into the post; and a locking release member moveably mounted to the housing body, the locking release member being moveable between a first position and a second position, the locking release member cooperating with a locking spring member, the locking spring member having a locking section which cooperates with a recess of the terminal post when the locking release member is in the first position;

a secondary locking element is positioned on the terminal post, the secondary locking member has a post locking member and an engagement member, the secondary locking member is positioned in a slot provided in a mating indicator at a top end of the terminal post, wherein when the terminal post is fully inserted into the housing body, the engagement member of the secondary locking member is moved toward the longitudinal center of the post, causing the secondary locking member to move to the second position, in which the post locking member engages or is positioned proximate to a top end of the housing body of the connector to prevent, the removal of the terminal post from the connector.

12. The in-line electrical connector as recited in claim 11, wherein the locking release member includes a locking spring member housed in a cavity, the locking spring member has a pair of mounting sections, locking sections positioned proximate the mounting sections have a radiused locking surface which cooperates with the terminal post.

13. The in-line electrical connector as recited in claim 11, wherein an anti-rotation device is provided to minimize or eliminate the effects of movement of the connector relative to the terminal post.

14. The in-line electrical connector as recited in claim 13, wherein the anti-rotation device includes radial ribs positioned on a post receiving end of the housing body, the ribs extend outward from the circumferences of the post receiving passage, circular key receiving recesses intersect the ribs.

15. The in-line electrical connector as recited in claim 11, wherein the terminal post includes a mating projection which extends from a top surface of the terminal post, a mating indicator is positioned on the mating projection, wherein when the terminal post is fully inserted into the housing body, a top portion of the mating indicator is positioned in an opening of a top end of the housing body to provide a visual indication that the connector is fully mated to the terminal post.

16. An electrical connector system for connecting an electrical connector to a terminal post, the electrical connector system comprising:

the electrical connector having a housing body with a post receiving passage for receiving the terminal post therein;

a contact provided in the post receiving passage, the contact positioned about the circumference of the post receiving passage wherein the contact will make an electrical engagement with the terminal post inserted into the post receiving passage regardless of the orientation of the terminal post with respect to the contact;

a locking release member moveably mounted to the housing body, the locking release member being moveable between a locking release member first position and a locking release member second position, the locking release member cooperating with a locking spring member, the locking spring member having a locking section which cooperates with a first recess of the terminal post when the locking release member is in the locking release member first position, the locking release member has a slot into which secondary locking member is positioned; and a secondary lock member to prevent the unwanted disengagement of the connector from the terminal, the secondary lock member being moveable between a first position and a second position, a stop member of the secondary locking member is positioned below the locking release member when the secondary locking member is in the first position, the stop member is positioned between the locking release member and a back wall of the housing body when the secondary locking member is in the second position, wherein when the secondary locking member is in the second position the locking release member is prevented from being depressed toward the back wall, preventing the removal of the terminal post from the electrical connector.

17. The electrical connector system as recited in claim 16, wherein an anti-rotation device is provided to minimize or eliminate the effects of movement of the connector relative to the terminal post.

18. The electrical connector system as recited in claim 17, wherein the anti-rotation device includes radial ribs positioned on a post receiving end of the housing body, the ribs extend outward from the circumferences of the post receiving passage, circular key receiving recesses intersect the ribs.

19. The electrical connector system as recited in claim 16, wherein the terminal post includes a mating projection which extends from a top surface of the terminal post, a mating indicator is positioned on the mating projection, wherein when the terminal post is fully inserted into the housing body, a top portion of the mating indicator is positioned in an opening of a top end of the housing body to provide a visual indication that the connector is fully mated to the terminal post.

* * * * *